US009864321B2

(12) United States Patent
Hirai

(10) Patent No.: US 9,864,321 B2
(45) Date of Patent: Jan. 9, 2018

(54) IMAGE FORMING APPARATUS, IMAGE FORMING SYSTEM AND LUBRICANT AMOUNT CONTROL METHOD

(71) Applicant: Konica Minolta, Inc., Chiyoda-ku, Tokyo (JP)

(72) Inventor: Atsuto Hirai, Nara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/222,991

(22) Filed: Jul. 29, 2016

(65) Prior Publication Data

US 2017/0045857 A1 Feb. 16, 2017

(30) Foreign Application Priority Data

Aug. 10, 2015 (JP) ..... 2015-158019

(51) Int. Cl.
*G03G 15/00* (2006.01)
*G03G 21/00* (2006.01)
*G03G 15/06* (2006.01)

(52) U.S. Cl.
CPC ..... *G03G 21/0094* (2013.01); *G03G 15/065* (2013.01)

(58) Field of Classification Search
CPC ..... G03G 15/065; G03G 21/0094
USPC ..... 399/53, 346
See application file for complete search history.

(56) References Cited

U.S. PATENT DOCUMENTS

2004/0047642 A1* 3/2004 Kosuge ..... G03G 15/081 399/53
2016/0291504 A1* 10/2016 Maeyama ..... G03G 21/0094

FOREIGN PATENT DOCUMENTS

| | | |
|---|---|---|
| JP | 2011-007987 | 1/2011 |
| JP | 2014-142472 | 8/2014 |
| JP | 2014-145864 | 8/2014 |
| JP | 2014-219645 A | 11/2014 |
| WO | 2003/067338 A1 | 8/2003 |

OTHER PUBLICATIONS

Office Action (Notice of Reasons for Rejection) dated Jun. 20, 2017, by the Japanese Patent Office in corresponding Japanese Patent Application No. 2015-158019, and an English translation of the Office Action. (10 pgs).

* cited by examiner

*Primary Examiner* — Sophia S Chen
(74) *Attorney, Agent, or Firm* — Buchanan Ingersoll & Rooney PC

(57) ABSTRACT

An image forming apparatus includes: an image bearing member to which lubricant is supplied; a developing section that forms a toner image by attaching toner to an electrostatic latent image formed on the image bearing member; and a control section that controls an amount of the lubricant in the developing section based on an area ratio of the toner image formed on the image bearing member and a development condition when the toner image is formed by the developing section.

20 Claims, 12 Drawing Sheets

IMAGE FORMING APPARATUS, IMAGE FORMING SYSTEM AND LUBRICANT AMOUNT CONTROL METHOD

CROSS REFERENCE TO RELATED APPLICATIONS

This application is entitled to and claims the benefit of Japanese Patent Application No. 2015-158019, filed on Aug. 10, 2015, the disclosure of which including the specification, drawings and abstract is incorporated herein by reference in its entirety.

BACKGROUND OF THE INVENTION

1. Field of the Invention

The present invention relates to an image forming apparatus, an image forming system and a lubricant amount control method.

2. Description of Related Art

In an image forming apparatus using an electrophotographic scheme, a cleaning device of a blade-cleaning type is known in which a plate-shaped cleaning blade composed of an elastic body and serving as a device for removing remaining toner such as untransferred toner and transfer residual toner on an image bearing member is brought into contact with the surface of the image bearing member to thereby remove the remaining toner on the image bearing member, for example.

In recent years, in image forming apparatuses using an electrophotographic scheme, reduction of toner particle size has been in demand from the view point of enhancing the image quality, and for such a purpose, polymerization methods such as an emulsion polymerization method and a suspension polymerization method have been utilized, for example. As the size of the toner particle decreases, however, the attaching force between the toner particle and the image bearing member increases, thus reducing the ease of removal of the remaining toner on the image bearing member. In particular, when so-called polymerization toner produced by a polymerization method is used, the toner particles have a substantially spherical shape, and as a result cleaning defects in which the toner particles roll on the image bearing member and slip through the cleaning blade are easily caused, thus further reducing the ease of removal of the remaining toner on the image bearing member. Furthermore, when toner slips through the cleaning blade, toner aggregate formed on the image bearing member is formed centered on the toner as the core, and grain blank slipping (grain noise) is generated on the solid image printing part.

To solve such a quality problem as the above-mentioned "slipping" and "grain noise" today, lubricant-external additive (lubricant) is supplied onto the image bearing member to perform cleaning in the state where the attaching force between the toner particle and the image bearing member is suppressed to a low level. Examples of the method for supplying lubricant onto the image bearing member include a lubricant application process in which lubricant is scraped by a brush and supplied to the surface of the image bearing member, a toner adding process in which a toner image is formed with use of lubricant-containing toner to supply the lubricant.

In the toner adding process, the lubricant exists in the developing section in a state in which the lubricant is adhered to or free from the toner, and when the toner is supplied to the image bearing member in the image section, the lubricant is also supplied onto the image bearing member. Since the lubricant is charged to a polarity opposite to that of the toner, the lubricant is also supplied onto the image bearing member in the background section. When images with a low area ratio are successively formed, lubricant is consumed in the background section, but there are fewer image sections and toner in the developing section is not consumed, and therefore new toner is not supplied into the developing section. The lubricant is supplied by the toner into the developing section, and so if this condition continues, the amount of lubricant in the developing section decreases.

When the amount of lubricant in the developing section decreases, there may be regions where the amount of lubricant supplied to the surface of the image bearing member decreases or regions where no lubricant exists, and it may be impossible to decrease the amount of lubricant attached to the toner—the purpose of supplying the lubricant to the image bearing member, which is more likely to cause problems such as slipping and grain noise.

In order to prevent the above-described problems, a patch image (toner image) is formed in a region other than the image region on the image bearing member when an image with a low area ratio is formed. With the formation of the patch image, the lubricant is supplied onto the image bearing member, and when the toner in the developing section is consumed, new toner is replenished into the developing section. When new toner is replenished, the lubricant is also replenished, thus preventing reduction of the amount of lubricant in the developing section and, by extension, preventing reduction in the amount of lubricant on the image bearing member as well.

The lubricant in the developing section may be supplied onto the image bearing member by forming the patch image with a certain margin based on the area ratio of images, but in that case, a patch image may be formed inadvertently even when the amount of lubricant in the developing section is appropriate. Since the toner used for the patch image is disposed without being processed, forming many patch images results in high printing cost.

When images with a high area ratio are successively formed, the new toner and the lubricant added in the toner are supplied into the developing section and the lubricant on the image bearing member is also collected from the image bearing member into the developing section, and so the amount of lubricant in the developing section increases. However, an excess of the amount of lubricant in the developing section may result in a reduction of the amount of charging of toner, causing problems such as fog toner into the background section and image quality degradation. Furthermore, when the amount of lubricant in the developing section increases, the amount of lubricant supplied onto the image bearing member also increases, causing the torque between the image bearing member and the cleaning blade to increase, resulting in a problem that turn-up of the blade or abrasion increases.

As described above, the amount of lubricant in the developing section and the amount of lubricant on the image bearing member have their respective appropriate ranges.

On the other hand, in the lubricant application process, lubricant is supplied onto the image bearing member by an application device such as a brush, but the lubricant on the image bearing member is collected into the developing section in the development region as in the case of the toner adding process. An increase in the amount of lubricant in the developing section may cause problems such as the occurrence of fog toner or image quality degradation. Conventionally, control is performed to eject the lubricant in the developing section onto the image bearing member in order to prevent an increase of the amount of lubricant in the developing section. Moreover, when lubricant is collected into the developing section and the amount of lubricant on the image bearing member decreases, problems such as slipping or grain noise occur as in the case of the toner adding process.

To solve the above-described problems, Japanese Patent Application Laid-Open No. 2014-142472 and Japanese Patent Application Laid-Open No. 2014-145864 disclose a configuration in which the amount of lubricant on an image bearing member is controlled based on an image area ratio of the surface of the image bearing member.

Japanese Patent Application Laid-Open No. 2014-142472 discloses a configuration in which the surface of a photoconductor drum is divided into a plurality of regions in a direction crossing the rotating direction and a supply of lubricant is controlled region by region.

Japanese Patent Application Laid-Open No. 2014-145864 discloses a configuration in which a patch image between images is formed based on gradation information of the images and lubricant is selectively supplied to a region where a cleaning defect is likely to occur.

However, since the amount of lubricant in the developing section varies depending on differences in an environment and the degree of toner degradation, even the configurations described in the above literature may be subject to problems such as slipping, grain noise or fog toner.

SUMMARY OF THE INVENTION

An object of the present invention is to provide an image forming apparatus, an image forming system and a lubricant amount control method capable of controlling the amount of lubricant in a developing section and on an image bearing member to an appropriate amount.

To achieve the abovementioned object, an image forming apparatus reflecting one aspect of the present invention includes: an image bearing member to which lubricant is supplied; a developing section configured to form a toner image by attaching toner to an electrostatic latent image formed on the image bearing member; and a control section configured to control an amount of the lubricant in the developing section based on an area ratio of the toner image formed on the image bearing member and a development condition when the toner image is formed by the developing section.

Desirably, in the image forming apparatus, the developing section supplies the lubricant onto the image bearing member by forming the toner image using the toner to which the lubricant has been added, and the development condition is a first potential difference between a developing bias when the toner image is formed and a first surface potential in a toner image formation region of the image bearing member in which the toner image is formed.

Desirably, in the image forming apparatus, the developing section forms the toner image using the toner to which the lubricant has been added and thereby supplies the lubricant onto the image bearing member, and the control section controls the amount of lubricant in the developing section based on a first potential difference between a developing bias when the toner image is formed and a first surface potential of a toner image formation region of the image bearing member in which the toner image is formed and a second potential difference between the developing bias and a second surface potential of a background region of the image bearing member in which the toner image is not formed.

Desirably, in the image forming apparatus, the developing section forms, on the image bearing member, a patch image in a patch image formation region which is different from a toner image formation region in which the toner image is formed, the patch image being different from the toner image, and when the area ratio of the toner image is smaller than a first predetermined area ratio, the control section controls the developing section, thereby controlling the amount of lubricant in the developing section via formation of the patch image.

Desirably, in the image forming apparatus, the developing section forms, on the image bearing member, a background image in a background image formation region which is different from a toner image formation region in which the toner image is formed, and when the area ratio of the toner image is greater than a second predetermined area ratio, the control section controls the developing section, thereby controlling the amount of lubricant in the developing section via formation of the background image.

Desirably, the image forming apparatus further includes a lubricant application section configured to supply the lubricant onto the image bearing member by applying the lubricant onto the image bearing member, in which the control section performs control such that the lubricant is supplied to the image bearing member from the developing section, thereby controlling the amount of lubricant in the developing section.

Desirably, in the image forming apparatus, the developing section forms, on the image bearing member, a patch image in a patch image formation region which is different from a toner image formation region in which the toner image is formed, the patch image being different from the toner image, and the control section controls the developing section to form the patch image and thereby controls the amount of lubricant in the developing section.

Desirably, in the image forming apparatus, the developing section forms, on the image bearing member, a background image in a background image formation region which is different from a toner image formation region in which the toner image is formed, and the control section controls the developing section to form the background image and thereby controls the amount of lubricant in the developing section.

Desirably, in the image forming apparatus, the patch image is formed at timing after the toner image formation region is formed but before a toner image formation region subsequent to the toner image formation region is formed.

Desirably, in the image forming apparatus, the background image is formed at timing after the toner image formation region is formed but before a toner image formation region subsequent to the toner image formation region is formed.

In addition, to achieve the abovementioned object, an image forming system reflecting one aspect of the present invention is composed of a plurality of units including an image forming apparatus, the image forming system including: an image bearing member to which lubricant is supplied; a developing section that forms a toner image by attaching toner to an electrostatic latent image formed on the image bearing member; and a control section that controls an amount of the lubricant in the developing section based on an area ratio of the toner image formed on the image bearing member and a development condition when the toner image is formed by the developing section.

In addition, to achieve the abovementioned object, a lubricant amount control method reflecting one aspect of the present invention is used in an image forming apparatus, the image forming apparatus including: an image bearing member; and a developing section that forms a toner image by attaching toner to an electrostatic latent image formed on the image bearing member, the method including: controlling an amount of lubricant in the developing section based on an area ratio of the toner image formed on the image bearing member to which the lubricant is supplied, and a development condition when the toner image is formed by the developing section.

Desirably, in the lubricant amount control method, the developing section supplies the lubricant onto the image bearing member by forming the toner image using the toner to which the lubricant has been added, and the development condition is a first potential difference between a developing bias when the toner image is formed and a first surface potential in a toner image formation region of the image bearing member in which the toner image is formed.

Desirably, in the lubricant amount control method, the developing section forms the toner image using the toner to which the lubricant has been added and thereby supplies the lubricant onto the image bearing member, and the amount of lubricant in the developing section is controlled based on a first potential difference between a developing bias when the toner image is formed and a first surface potential of a toner image formation region of the image bearing member in which the toner image is formed and a second potential difference between the developing bias and a second surface potential of a background region of the image bearing member in which the toner image is not formed.

Desirably, in the lubricant amount control method, the developing section forms, on the image bearing member, a patch image in a patch image formation region which is different from a toner image formation region in which the toner image is formed, the patch image being different from the toner image, and when the area ratio of the toner image is smaller than a first predetermined area ratio, the amount of lubricant in the developing section is controlled by controlling the developing section to form the patch image.

Desirably, in the lubricant amount control method, the developing section forms, on the image bearing member, a background image in a background image formation region which is different from a toner image formation region in which the toner image is formed, and when the area ratio of the toner image is greater than a second predetermined area ratio, the amount of lubricant in the developing section is controlled by controlling the developing section to form the background image.

Desirably, in the lubricant amount control method, the image forming apparatus further includes a lubricant application section configured to supply the lubricant onto the image bearing member by applying the lubricant onto the image bearing member, in which control is performed such that the lubricant is supplied to the image bearing member from the developing section, thereby controlling the amount of lubricant in the developing section.

Desirably, in the lubricant amount control method, the developing section forms, on the image bearing member, a patch image in a patch image formation region which is different from a toner image formation region in which the toner image is formed, the patch image being different from the toner image, and the developing section is controlled to form the patch image to thereby control the amount of lubricant in the developing section.

Desirably, in the lubricant amount control method, the developing section forms, on the image bearing member, a background image in a background image formation region which is different from a toner image formation region in which the toner image is formed, and the developing section is controlled to form the background image to thereby control the amount of lubricant in the developing section.

Desirably, in the lubricant amount control method, the patch image is formed at timing after the toner image formation region is formed but before a toner image formation region subsequent to the toner image formation region is formed.

DESCRIPTION OF THE PREFERRED EMBODIMENTS

Figure 1:
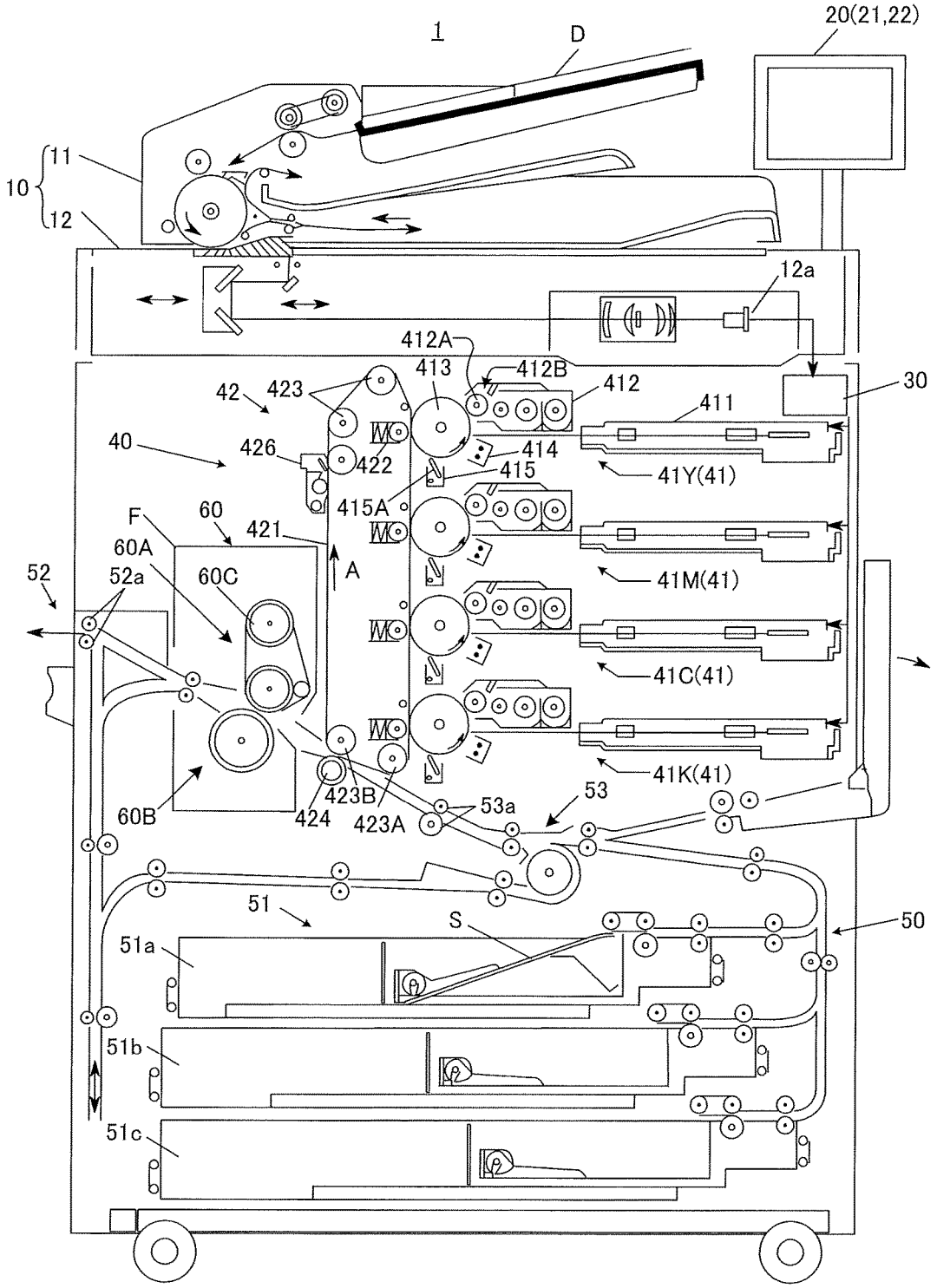
FIG. 1 schematically illustrates an entire structure of an image forming apparatus according to Embodiment 1.
Figure 2:
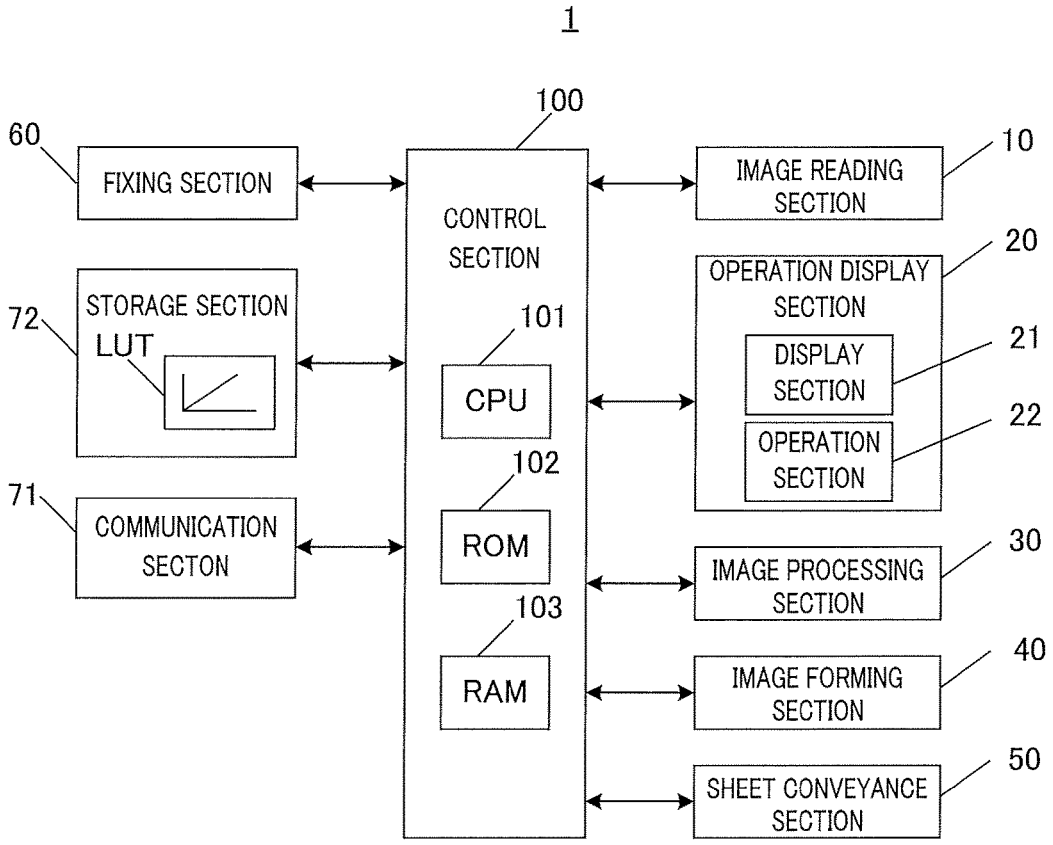
FIG. 2 illustrates a principal part of a control system of the image forming apparatus according to Embodiment 1.

Hereinafter, Embodiment 1 will be described in detail based on the accompanying drawings. FIG. 1 schematically illustrates an entire structure of image forming apparatus 1 according to Embodiment 1. FIG. 2 illustrates a principal part of a control system of image forming apparatus 1 according to Embodiment 1. Image forming apparatus 1 shown in FIGS. 1 and 2 is a color image forming apparatus of an intermediate transfer type using an electrophotographic process technique. That is, image forming apparatus 1 primary-transfers toner images of different colors of Y (yellow), M (magenta), C (cyan) and K (black) formed on photoconductor drum 413 to intermediate transfer belt 421, superimposes the four color toner images one on another on intermediate transfer belt 421, then secondary-transfers them to sheet S and thereby forms an image.

A tandem scheme is adopted for image forming apparatus 1, in which photoconductor drums 413 corresponding to four YMCK colors are arranged in series in a traveling direction of intermediate transfer belt 421 and toner images of the respective colors are sequentially transferred to intermediate transfer belt 421 by one procedure.

As shown in FIG. 2, image forming apparatus 1 is provided with image reading section 10, operation display section 20, image processing section 30, image forming section 40, sheet conveyance section 50, fixing section 60 and control section 100.

Control section 100 includes central processing unit (CPU) 101, read only memory (ROM) 102, random access memory (RAM) 103 and the like. CPU 101 reads a program suited to processing contents out of ROM 102, develops the program in RAM 103, and integrally controls an operation of each block of image forming apparatus 1 in cooperation with the developed program. At this time, CPU 101 refers to various kinds of data stored in storage section 72. Storage section 72 is composed of, for example, a non-volatile semiconductor memory (so-called flash memory) or a hard disk drive. In the present embodiment, storage section 72 stores image formation information relating to a printing job to be executed by image forming section 40. The image formation information includes, for example, information on the number of prints and an image area ratio of an input image.

Control section 100 transmits and receives various kinds of data to and from an external apparatus (for example, a personal computer) connected to a communication network such as a local area network (LAN) or a wide area network (WAN), through communication section 71. Control section 100 receives, for example, image data transmitted from the external apparatus, and performs control to form an image on sheet S on the basis of the image data (input image data). Communication section 71 is composed of, for example, a communication control card such as a LAN card.

As shown in FIG. 1, image reading section 10 includes auto document feeder (ADF) 11, document image scanning device 12 (scanner), and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

As shown in FIG. 2, operation display section 20 includes, for example, a liquid crystal display (LCD) with a touch panel, and functions as display section 21 and operation section 22. Display section 21 displays various operation screens, image conditions, operating statuses of functions, and the like in accordance with display control signals received from control section 100. Operation section 22 includes various operation keys such as numeric keys and a start key, receives various input operations performed by a user, and outputs operation signals to control section 100.

Image processing section 30 includes a circuit that performs a digital image process suited to initial settings or user settings on the input image data, and the like. For example, image processing section 30 performs tone correction on the basis of tone correction data (tone correction table), under the control of control section 100. In addition to the tone correction, image processing section 30 also performs various correction processes such as color correction and shading correction as well as a compression process, on the input image data. Image forming section 40 is controlled on the basis of the image data that has been subjected to the processes.

As shown in FIG. 1, image forming section 40 includes image forming units 41Y, 41M, 41C, and 41K that form images of colored toners of a Y component, an M component, a C component, and a K component on the basis of the input image data, intermediate transfer unit 42, and the like.

Image forming units 41Y, 41M, 41C, and 41K for the Y component, the M component, the C component, and the K component have a similar configuration. For ease of illustration and description, common elements are denoted by the same reference numerals. Only when elements need to be discriminated from one another, Y, M, C, or K is added to their reference numerals. In FIG. 1, reference numerals are given to only the elements of image forming unit 41Y for the Y component, and reference numerals are omitted for the elements of other image forming units 41M, 41C, and 41K.

Image forming unit 41 is provided with exposure device 411, developing device 412, photoconductor drum 413, charging apparatus 414 and drum cleaning apparatus 415, and the like.

Photoconductor drum 413 is composed of an organic photoconductor in which a photosensitive layer made of a resin containing an organic photoconductive member is formed on the outer peripheral surface of a drum-like metal base, for example. Examples of the resin of the photosensitive layer include polycarbonate resin, silicone resin, polystyrene resin, acrylic resin, methacryl resin, epoxy resin, polyurethane resin, chloride vinyl resin, melamine resin and the like.

Control section 100 controls a driving current supplied to a driving motor (not shown in the drawings) that rotates photoconductor drums 413, whereby photoconductor drums 413 are rotated at a constant circumferential speed.

Charging device 414 is, for example, a charging charger and causes corona discharge to thereby evenly negatively charge the surface of photoconductor drum 413 having photoconductivity.

Exposure device 411 is composed of, for example, a semiconductor laser, and configured to irradiate photoconductor drum 413 with laser light corresponding to the image of each color component. As a result, electrostatic latent images for the respective color components are formed on an image area irradiated with laser light of the surface of photoconductor drum 413 due to a potential difference from the background area.

Developing device 412 is a developing device of a two-component reverse type, and attaches developers of respective color components to the surface of photoconductor drums 413, and visualizes the electrostatic latent image to form a toner image.

Note that the developer is made up of a mixture of toner and a carrier for charging the toner. In the present embodiment, the toner is negatively charged. The toner is not particularly limited, but it is possible to use toner resulting from including a coloring agent, and a charge control agent, a releasing agent or the like as required in binder resin and adding lubricant G thereto. The toner preferably has a particle diameter of on the order of 3 to 15 [μm].

Note that as the carrier, a publicly known carrier which is generally used, for example, binder type carrier or coat-type carrier can be used. The carrier preferably has a particle diameter of on the order of 15 to 100 [μm].

In the present embodiment, lubricant having lubricity is added in the toner. The lubricant is charged to a polarity opposite to the charging polarity of the toner and has a smaller particle diameter than the toner. In the present embodiment, the lubricant is positively charged.

Examples of the lubricant include fatty acid metal salt, silicone oil, fluorine resin and the like, which may be used alone or in combination. Among them, fatty acid metal salt is preferable as the lubricant. The fatty acid is preferably a straight-chain hydrocarbon, and for example, myristic acid, palmitic acid, stearic acid, oleic acid and the like are preferable. Among them, stearic acid is more preferable. Examples of the metal include lithium, magnesium, calcium, strontium, zinc, cadmium, aluminum, celium, titanium, and iron. Among them, zinc stearate, stearic acid magnesium, stearic acid aluminum, stearic acid iron and the like are preferable, and zinc stearate is most preferable.

Developing device 412 includes developing sleeve 412A that is disposed to face photoconductor drum 413 with the development region therebetween. Developing sleeve 412A is disposed in developing section 412B in developing device 412. The toner from the toner storage section in developing device 412 and the lubricant added in the toner are supplied into developing section 412B.

For example, a direct current developing bias having a polarity same as the charging polarity of charging apparatus 414, or a developing bias in which a direct current voltage having a polarity same as the charging polarity of charging apparatus 414 is superimposed on an alternating current voltage is applied to developing sleeve 412A. Thus, reversal development for attaching toner to an electrostatic latent image formed by exposing device 411 is performed.

Drum cleaning device 415 is brought into contact with the surface of photoconductor drum 413, includes plate-shaped drum cleaning blade 415A composed of an elastic body and the like, and removes the toner remaining on the surface of photoconductor drum 413 which has not been transferred to intermediate transfer belt 421.

Intermediate transfer unit 42 includes intermediate transfer belt 421, primary transfer roller 422, a plurality of support rollers 423, secondary transfer roller 424, belt cleaning device 426 and the like.

Intermediate transfer unit 42 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer nip can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 100. Note that, the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face backup roller 423B disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip for transferring a toner image from intermediate transfer belt 421 to sheet S is formed.

When intermediate transfer belt 421 passes through the primary transfer nip, the toner images on photoconductor drums 413 are sequentially primary-transferred to intermediate transfer belt 421. More specifically, a primary transfer bias is applied to primary transfer rollers 422, and an electric charge of the polarity opposite to the polarity of the toner is applied to the rear side of intermediate transfer belt 421, that is, the side that makes contact with primary transfer rollers 422, whereby the toner image is electrostatically transferred to intermediate transfer belt 421.

Thereafter, when sheet S passes through the secondary transfer nip, the toner image on intermediate transfer belt 421 is secondary-transferred to sheet S. More specifically, a secondary transfer bias is applied to secondary transfer roller 424, and an electric charge of the polarity opposite to the polarity of the toner is applied to the rear side, that is, the side that makes contact with secondary transfer roller 424 of sheet S, whereby the toner image is electrostatically transferred to sheet S. Sheet S to which the toner images have been transferred is conveyed toward fixing section 60.

Belt cleaning device 426 removes transfer residual toner which remains on the surface of intermediate transfer belt 421 after a secondary transfer. A configuration in which a secondary transfer belt is installed in a stretched state in a loop form around a plurality of support rollers including a secondary transfer roller, that is, a so-called belt-type secondary transfer unit may also be adopted in place of secondary transfer roller 424.

Fixing section 60 includes upper fixing section 60A having a fixing surface of sheet S, that is, a fixing side member disposed on the side on which a toner image is formed, lower fixing section 60B having the rear surface side of sheet S, that is, a back side supporting member disposed on the surface opposite to the fixing surface, and heating source 60C, and the like. The back side supporting member is brought into pressure contact with the fixing side member, whereby a fixing nip for conveying sheet S in a tightly sandwiching manner is formed.

Fixing section 60 applies, at the fixing nip, heat and pressure to sheet S on which a toner image has been secondary-transferred, thereby fixing the toner image on sheet S. Fixing section 60 is disposed as a unit in fixing part F. In addition, fixing part F may be provided with an air-separating unit that blows air to separate sheet S from the fixing side member or the back side supporting member.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 includes a plurality of pairs of conveyance rollers such as a pair of resist rollers 53*a*.

Sheets S stored in sheet tray units 51*a* to 51*c* are outputted one by one from the uppermost, and conveyed to image forming section 40 by conveyance path section 53. At this time, the resist roller section in which the pair of resist rollers 53*a* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Sheet S on which an image has been formed is ejected out of the image forming apparatus by sheet ejection section 52 including sheet ejection rollers 52*a*.

Next, developing device 412 and peripheral parts, and control section 100 according to Embodiment 1 will be described with reference to FIG. 3.

Figure 3:
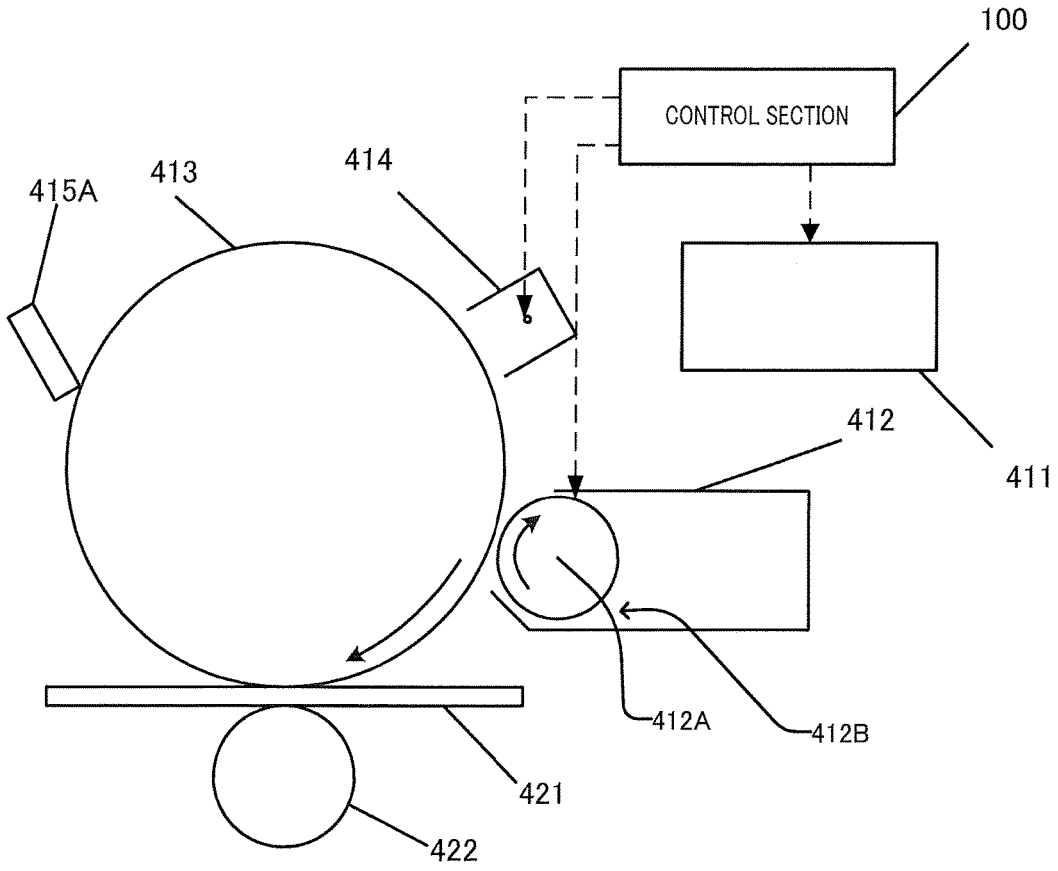
FIG. 3 illustrates a developing device and peripheral parts, and a control section according to Embodiment 1.

As shown in FIG. 3, control section 100 controls light exposure potential Vi which is a surface potential of photoconductor drum 413 after the light exposure by exposure device 411, a direct current component of developing bias Vdc and charging potential Vo which is a surface potential of photoconductor drum 413 after the charging of charging apparatus 414, to thereby control development conditions of developing device 412. Light exposure potential Vi corresponds to a "first surface potential" of the present invention and charging potential Vo corresponds to a "second surface potential" of the present invention.

Control section 100 performs control to set an image forming condition when stabilizing images at the start of a printing job. More specifically, since control section 100 needs to keep image concentration, image quality, or the like constant even if there is a difference in an environment or the degree of toner degradation, control section 100 adjusts a developing bias, a transfer voltage or the like and determines an appropriate image forming condition as a result of the adjustment.

For example, in a high-temperature high-humidity environment or in the case of toner degradation, the charging amount of toner decreases, and so control section 100 decreases a potential difference between an image region of photoconductor drum 413 and developing sleeve 412A, that is, a potential difference between developing bias Vdc and light exposure potential Vi (hereinafter referred to as "image part potential difference"). In a low temperature low humidity environment or when the toner is in an initial state, the charging amount of toner increases, and so control section 100 increases the image part potential difference. The image part potential difference corresponds to a "first potential difference" of the present invention.

With regard to the transfer voltage, since the electric resistance of intermediate transfer belt 421 changes depending on the charging amount of toner and the environment conditions, control section 100 sets a transfer voltage corresponding to the change.

Figure 4A:
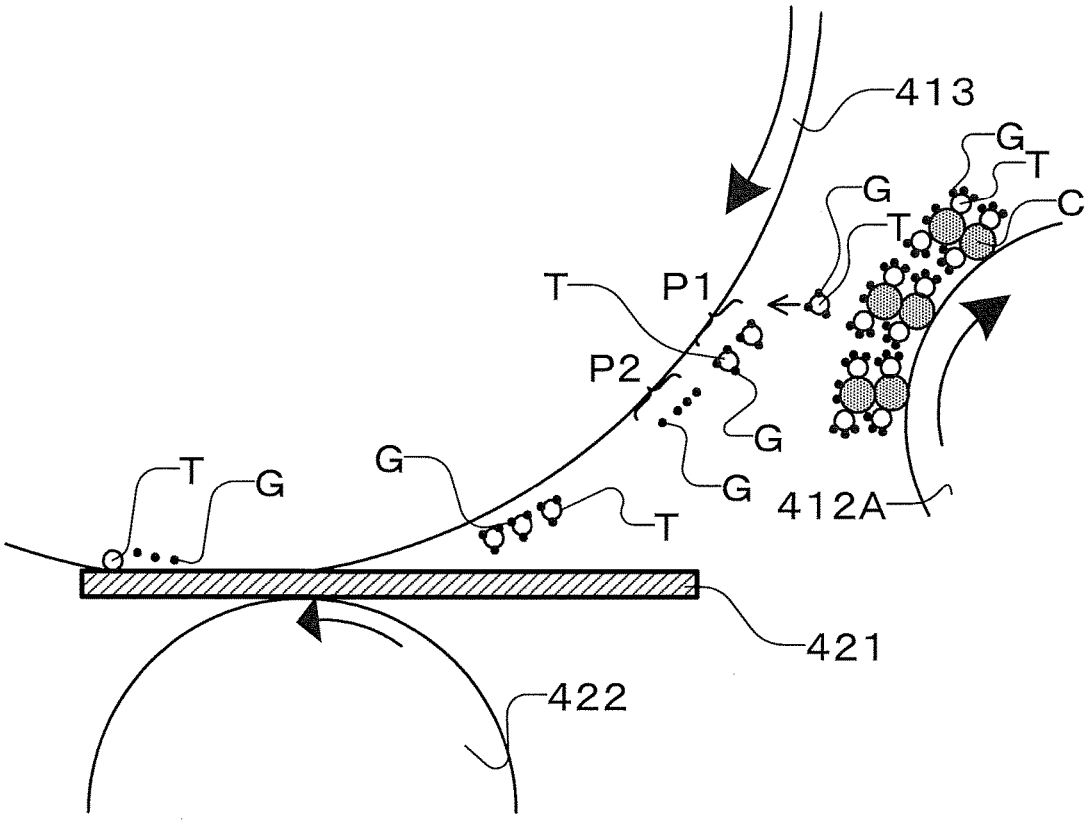
FIG. 4A illustrates movements of toner and lubricant.
Figure 4B:
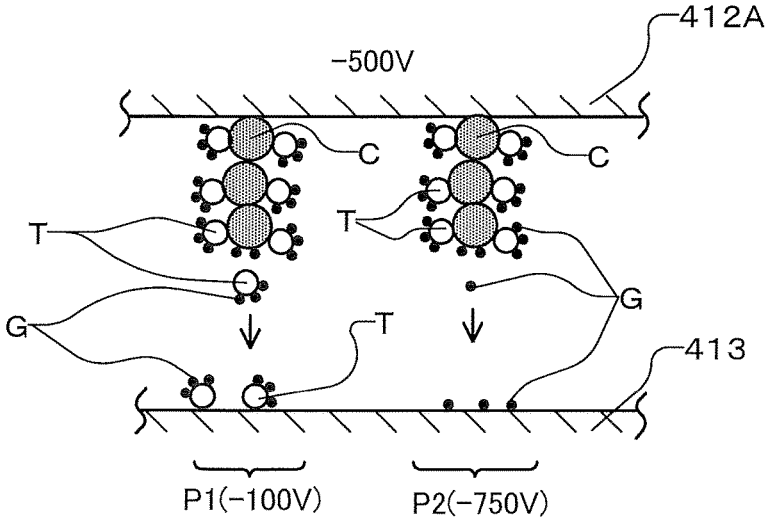
FIG. 4B is an enlarged view of a part where a developing sleeve and a photoconductor drum face each other.
Figure 5A:
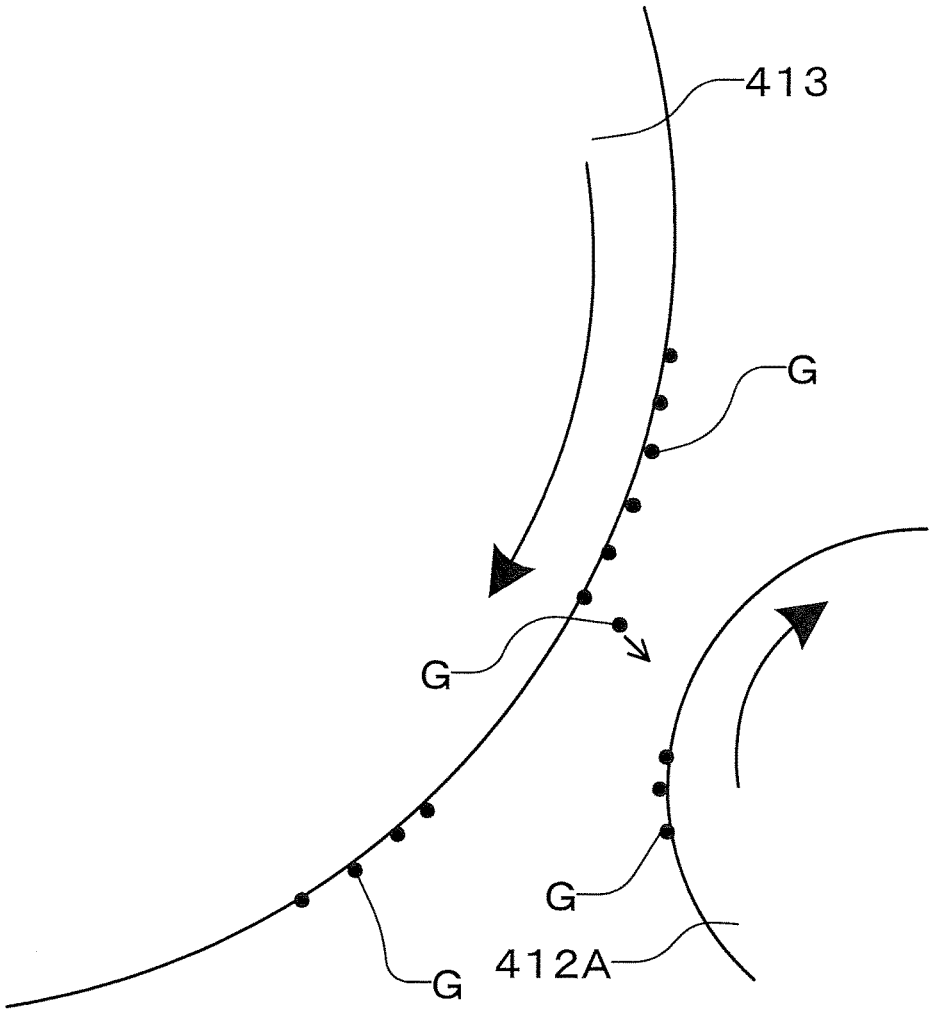
FIG. 5A is a diagram for describing how lubricant is collected to the developing sleeve.
Figure 5B:
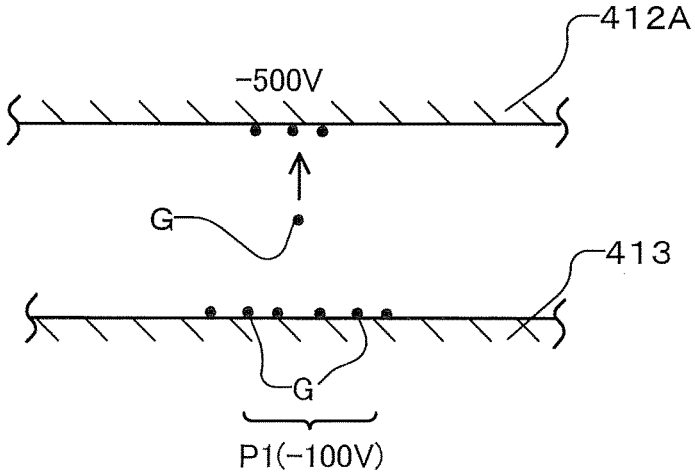
FIG. 5B is an enlarged view of the part where the developing sleeve and the photoconductor drum face each other.

Next, a series of operations of supply and collection of lubricant by image forming apparatus 1 according to the present embodiment will be described. FIG. 4A is a diagram illustrating movements of toner T and lubricant G, FIG. 4B is an enlarged view of a part where developing sleeve 412A and photoconductor drum 413 face each other. FIG. 5A is a diagram for describing how lubricant G is collected by developing sleeve 412A and FIG. 5B is an enlarged view of the part where developing sleeve 412A and photoconductor drum 413 face each other.

Note that in Embodiment 1, light exposure potential Vi of photoconductor drum 413 is set to −100 [V]. Charging potential Vo of photoconductor drum 413 is set to −750 [V]. Developing bias Vdc is set to −500 [V] during image formation. These voltage values may also be set as appropriate according to the embodiments.

In the following description, the potential difference between background region P2 of photoconductor drum 413 and developing sleeve 412A, that is, the potential difference of charging potential Vo with respect to developing bias Vdc is assumed to be a background part potential difference. The background part potential difference corresponds to a "second potential difference" of the present invention.

First, a supply of lubricant G onto photoconductor drum 413 will be described. As shown in FIG. 4A and FIG. 4B, when a printing job is started, toner T mixed with carrier C is supported on developing sleeve 412A to which developing bias Vdc is applied and moves to a position facing photoconductor drum 413 along with the rotation of developing sleeve 412A.

Since the image part potential difference in image region P1 is +400 [V], an electric field in a positive direction applies to the direction from developing sleeve 412A to photoconductor drum 413. Thus, negatively charged toner T moves to the photoconductor drum 413 side. At this time, lubricant G added to toner T also moves onto photoconductor drum 413 together with toner T.

Toner T and lubricant G which have moved onto photoconductor drum 413 move to a position at which intermediate transfer belt 421 is sandwiched between photoconductor drum 413 and primary transfer roller 422 along with the rotation of photoconductor drum 413. Since a positive transfer voltage is applied to primary transfer roller 422, negative toner T moves to intermediate transfer belt 421. Note that, in the present embodiment, the transfer voltage is set to 500 [V], but the transfer voltage can be set to any appropriate voltage according to the embodiment.

At this time, since lubricant G has a positive polarity, lubricant G is pressed against the photoconductor drum 413 side by an electric field generated between primary transfer roller 422 and photoconductor drum 413. This causes lubricant G to be detached from toner T and remain on photoconductor drum 413. Furthermore, since photoconductor drum 413 and intermediate transfer belt 421 are in contact with each other, a greater electric field is formed therebetween than between photoconductor drum 413 and developing sleeve 412A which are not in contact with each other, and therefore lubricant G is more likely to be detached from toner T. By this means, lubricant G is supplied onto photoconductor drum 413.

On the other hand, since the background part potential difference in background region P2 is −250 [V], an electric field in a negative direction applies to the direction from developing sleeve 412A to photoconductor drum 413. Therefore, negative toner T does not move toward the photoconductor drum 413 side. However, lubricant G charged to a positive polarity is detached from toner T and moves to the photoconductor drum 413 side. Furthermore, lubricant G detached from toner T on developing sleeve 412A also moves to the photoconductor drum 413 side.

When images with a low area ratio, that is, images having a high proportion of background region P2 are successively formed, lubricant G is excessively supplied to photoconductor drum 413. When lubricant G is excessively supplied to photoconductor drum 413, the amount of lubricant G in developing section 412B runs short, and therefore the amount of lubricant G supplied to photoconductor drum 413 decreases, toner T is more likely to remain on photoconductor drum 413, and slipping, grain noise or the like is more likely to occur.

However, in the present embodiment, when forming a toner image with a low area ratio smaller than a first predetermined area ratio, control section 100 performs control to form a patch image in a patch image formation region different from the toner image formation region of photoconductor drum 413. When control section 100 performs control to form a patch image, the toner in developing section 412B is supplied to photoconductor drum 413, and new toner T and lubricant G added to toner T are supplied into developing section 412B accordingly. Thus, it is possible to prevent a shortage of lubricant G in developing section 412B, and by extension, prevent the occurrence of slipping, grain noise or the like.

Note that the first predetermined area ratio is an area ratio in which the proportion of the image region with respect to the printing region of sheet S is smaller than the proportion of the white background region, and refers to such an area ratio that problems such as slipping, grain noise would never occur even when, for example, a relatively large number of sheets, for example, 5000 sheets are printed within a range of image part potential difference when a toner image is formed, and can be set as appropriate through experiments or the like.

When forming a patch image, control section 100 performs control to change the image part potential difference according to the area ratio of the toner image in a printing job. This makes it possible to adjust the amount of toner of the patch image formed and adjust the amount of lubricant supplied into developing section 412B. Note that the image part potential difference at this time may also be calculated from a table such as Table 2 which will be described later, for example, associated with the area ratio of the toner image stored in storage section 72 or the like in advance and can be set as appropriate through experiments or the like.

Next, collection of lubricant G on photoconductor drum 413 by developing sleeve 412A will be described.

As shown in FIG. 5A and FIG. 5B, the part of photoconductor drum 413 on which an image is formed makes one revolution and moves to a position where it faces developing sleeve 412A again. At this time, since developing bias Vdc is small with respect to the relevant part, that is, light exposure potential Vi, an electric field acts in a negative direction from photoconductor drum 413 to developing sleeve 412A. For this reason, lubricant G charged to a positive polarity moves to the developing sleeve 412A side.

In image region P1, since an electric field in a negative direction acts in the direction from photoconductor drum 413 to developing sleeve 412A, lubricant G charged to a positive polarity moves to the developing sleeve 412A side. By this means, lubricant G on photoconductor drum 413 is collected by developing sleeve 412A.

On the other hand, in background region P2, since an electric field in a positive direction acts in a direction from photoconductor drum 413 to developing sleeve 412A, lubricant G charged to a positive polarity remains on photoconductor drum 413 and is not collected by developing sleeve 412A.

However, when images with a high area ratio, that is, images having a high proportion of image region P1 are successively formed, lubricant G on photoconductor drum 413 is excessively collected by developing sleeve 412A. When lubricant G is excessively collected by developing sleeve 412B, the amount of charge of toner T decreases, and quality-related problems such as fog toner are likely to occur.

However, in the present embodiment, when forming an image with a high area ratio where an area ratio of a toner image is higher than a second predetermined area ratio, control section 100 performs control to form a background image which is a white image on photoconductor drum 413 in a background image formation region which is different from the toner image formation region. Since an electric field where toner T will not move is formed between background region P2 and developing sleeve 412A, lubricant G having a charging polarity opposite to that of toner T is more likely to move toward the photoconductor drum 413 side and lubricant G is not likely to be collected from photoconductor drum 413 into developing sleeve 412A. This prevents the amount of lubricant G from increasing excessively in developing section 412B, and by extension, prevents the occurrence of quality problems such as fog toner.

Note that the second predetermined area ratio is an area ratio in which the proportion of image region P1 with respect to the printing region of sheet S is higher than the proportion of white background region P2 and refers to such an area ratio that problems such as slipping, image quality degradation would never occur even when, for example, a relatively large number of sheets, for example, 4000 sheets are printed within a range of image part potential difference when a toner image is formed, and can be set as appropriate through experiments or the like.

When forming a background image, control section 100 performs control to change the background part potential difference according to the area ratio of the toner image in a printing job. This makes it possible to adjust the amount of lubricant ejected from within developing section 412B into photoconductor drum 413. Note that the background part potential difference at this time may also be calculated from a table associated with the area ratio of the toner image stored in storage section 72 or the like in advance and can be set as appropriate through experiments or the like.

Control section 100 determines a specified number of prints in a printing job from the image part potential difference defined at the start of printing and the area ratio of a toner image inputted in the printing job. When the number of prints reaches the specified number of prints, control section 100 performs control to form the above-described patch image or background image. It is therefore possible to form a patch image and a background image at appropriate timing.

The specified number of prints is such a number of prints that exceeding this number may cause problems such as slipping, grain noise or fog toner for reasons related to the image part potential difference set at the start of printing and the area ratio of a toner image. The specified number of prints may also be calculated from a table such as Table 1, which will be described later, that associates the image part potential difference stored in storage section 72 or the like in advance with the area ratio of the toner image or by correcting the number of sheets set for each image part potential difference with the amount of change of the potential difference or may be set through experiments or the like as appropriate.

Figure 6:
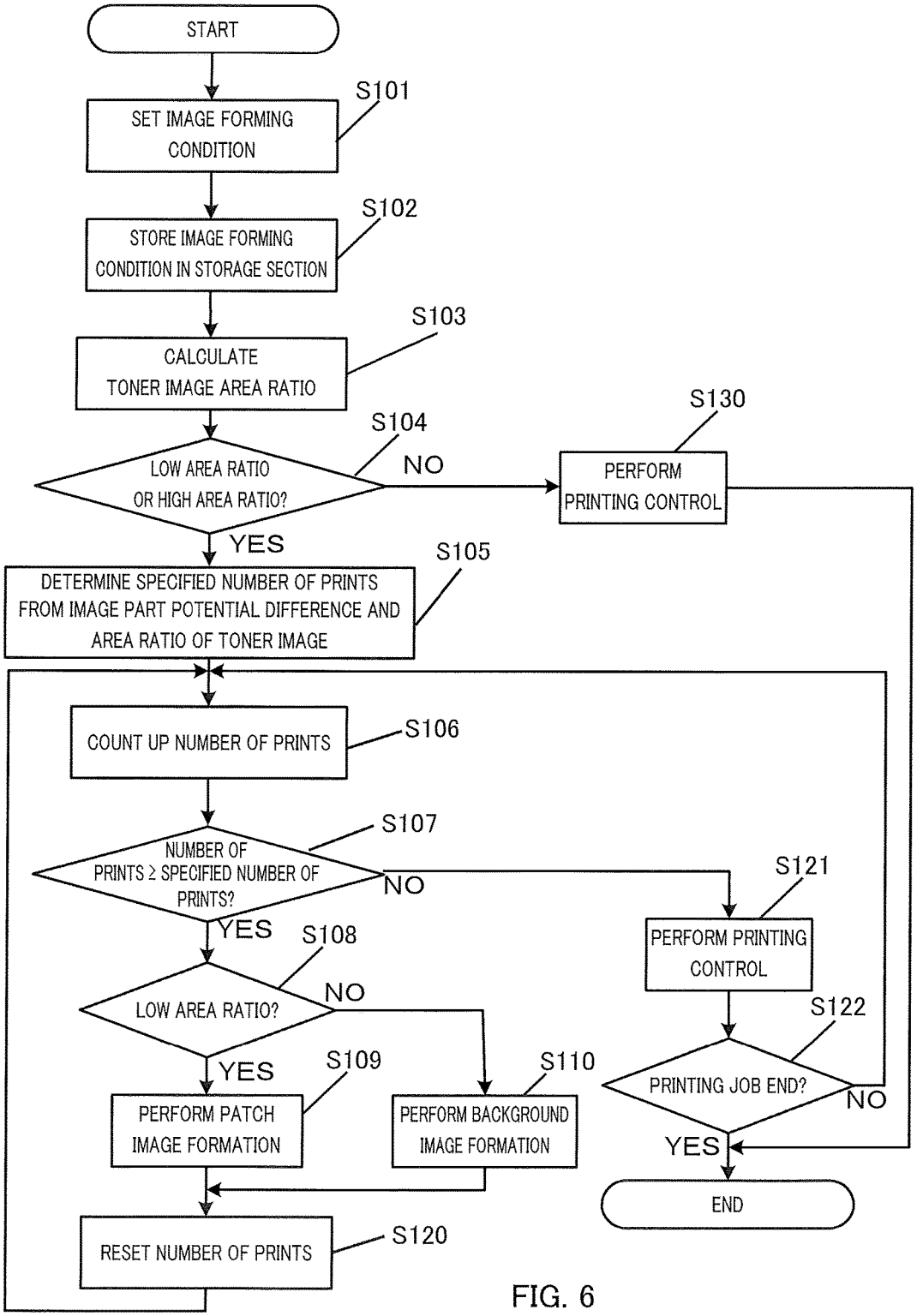
FIG. 6 is a flowchart illustrating an operation example of lubricant amount control in the developing section according to Embodiment 1.

FIG. 6 is a flowchart illustrating an operation example of the lubricant amount control in developing section 412B by control section 100 according to Embodiment 1. Processes in FIG. 6 are executed when control section 100 receives an instruction for executing a printing job.

When a printing job starts, control section 100 sets an image forming condition first (step S101). Next, control section 100 stores the image forming condition set at step S101 in storage section 72 (step S102). Next, control section 100 calculates an area ratio of a toner image in the printing job from the image formation information stored in storage section 72 (step S103).

Next, control section 100 determines whether the area ratio of the toner image is a low area ratio (e.g., 10% or less) or a high area ratio (e.g., 60% or more) (step S104). When the determination result shows that the area ratio of the toner image is a low area ratio or a high area ratio (step S104, YES), control section 100 determines the specified number of prints in the printing job from the image part potential difference set at step S101 and the area ratio of the toner image calculated at step S103 (step S105).

Next, control section 100 counts up the number of prints in the printing job (step S106). Next, control section 100 determines whether or not the number of prints is equal to or greater than the specified number of prints (step S107). When the determination result shows that the number of prints is equal to or greater than the specified number of prints (step S107, YES), control section 100 determines whether or not the area ratio of the toner image is a low area ratio (step S108).

When the determination result shows that the area ratio of the toner image is a low area ratio (step S108, YES), control section 100 forms a patch image (step S109). To be more specific, control section 100 performs control to change the image part potential difference in the patch image formation according to the area ratio of the toner image.

On the other hand, when the area ratio of the toner image is not a low area ratio, that is, the area ratio of the toner image is a high area ratio (step S108, NO), control section 100 forms a background image (step S110). More specifically, control section 100 performs control to change the background part potential difference in background image formation according to the area ratio of the toner image.

After steps S109 and S110, control section 100 resets the value of the number of prints and sets the value to 0 (step S120). After that, the process returns to a point before step S106.

Returning to the determination at step S107, if the number of prints is less than the specified number of prints (step S107, NO), control section 100 executes printing control (step S121). Lastly, control section 100 determines whether or not the printing job in progress has ended (step S122). When the determination result shows that the printing job in progress has ended (step S122, YES), image forming apparatus 1 ends the processes in FIG. 6. On the other hand, when the printing job in progress has not ended (step S122, NO), the process returns to a point before step S106.

Returning to the determination at step S104, if the area ratio of the toner image is not a low area ratio or a high area ratio (step S104, NO), control section 100 executes printing control (step S130), and image forming apparatus 1 ends the processes in FIG. 6.

As described in detail above, image forming apparatus 1 according to Embodiment 1 is provided with photoconductor drum 413 to which lubricant is supplied, developing section 412B that collects the lubricant from photoconductor drum 413 by forming a toner image on photoconductor drum 413, and control section 100 that controls the amount of lubricant in developing section 412B based on an area ratio of the toner image in a printing job and a development condition of developing section 412B when forming the toner image.

According to Embodiment 1 configured as described above, since the amount of lubricant in developing section 412B is controlled based on the area ratio of the toner image and a development condition, it is possible to control the amount of lubricant in developing section 412B and on photoconductor drum 413 to an appropriate amount. Furthermore, since control section 100 adjusts the image part potential difference to an appropriate value at the start of printing, it is possible to prevent the amount of lubricant in developing section 412B from changing due to differences in an environment or a degree and toner degradation.

When images with a low area ratio are successively formed, since control section 100 performs control to form a patch image, it is possible to prevent shortage of the amount of lubricant in developing section 412B, and by extension, prevent the occurrence of slipping or grain noise.

When the number of prints reaches the specified number of prints calculated with the area ratio of the toner image and under the development condition, control section 100 forms a patch image, and it is therefore possible to form the patch image at appropriate timing. This eliminates the possibility to form unnecessary patch images and can thereby reduce the amount of toner consumption.

When successively forming images with a high area ratio, control section 100 performs control to form a background image, and it is thereby possible to prevent the amount of lubricant in developing section 412B from increasing excessively, and by extension, prevent the occurrence of fog toner or image quality degradation or the like. The amount of lubricant supplied from developing section 412B to photoconductor drum 413 together with toner never increases excessively, and it is thereby possible to prevent the torque between photoconductor drum 413 and drum cleaning blade 415A from increasing, and prevent turn-up or abrasion of drum cleaning blade 415A.

Since control section 100 forms a patch image or a background image in a patch image formation region or a background image formation region which is different from a toner image formation region, it is not necessary to suspend printing operation. This makes it possible to prevent the number of prints per unit time from decreasing and thus to improve printing efficiency.

Next, Embodiment 2 will be described in detail with reference to the accompanying drawings as appropriate. Note that components substantially the same as those in Embodiment 1 are assigned the same reference numerals and the description thereof will be omitted.

Figure 7:
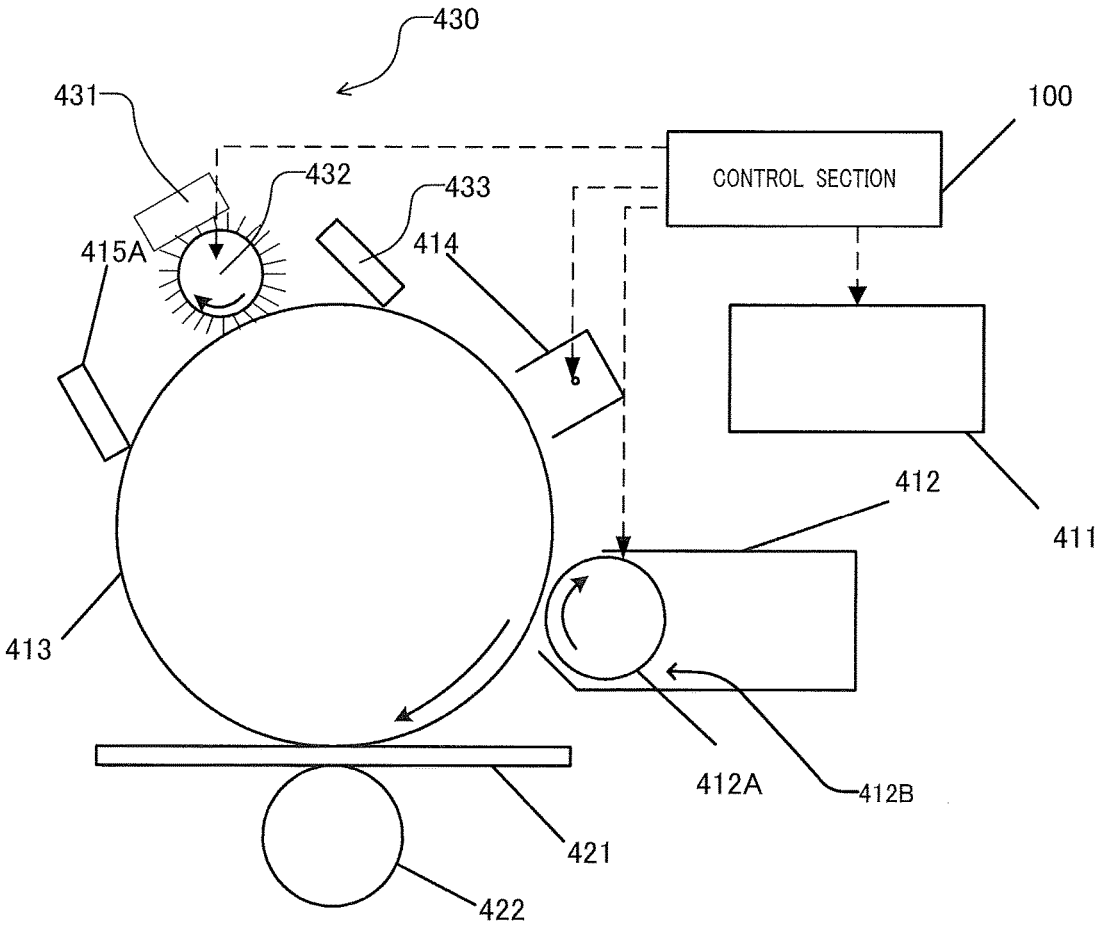
FIG. 7 is a diagram illustrating a developing device and peripheral parts, and a control section according to Embodiment 2.

FIG. 7 is a diagram illustrating developing device 412 and control section 100 according to Embodiment 2.

As shown in FIG. 7, developing device 412 is provided with lubricant application section 430 disposed on the downstream side of drum cleaning blade 415A in the rotating direction of photoconductor drum 413 in addition to the configuration of Embodiment 1. No lubricant is added to toner stored in developing device 412. Note that in the following description, the rotating direction of photoconductor drum 413 will be simply referred to as "rotating direction."

Lubricant application section 430 is provided with lubricant rod 431, brush 432 and blade 433.

Lubricant rod 431 is a material of lubricant formed into a rod shape through compression molding or the like and disposed at a position separate from photoconductor drum 413.

Brush 432 is rotatably disposed between lubricant rod 431 and photoconductor drum 413, and in contact with both. As brush 432 rotates, brush 432 scrapes lubricant from lubricant rod 431 and holds the lubricant in brush 432. Brush 432 supplies the held lubricant onto photoconductor drum 413.

Blade 433 is a rubber-like leveling blade and disposed on the downstream side of lubricant rod 431 and brush 432 in the rotating direction. Blade 433 is configured to press the lubricant supplied onto photoconductor drum 413 against photoconductor drum 413. The lubricant is applied onto photoconductor drum 413 when pressed by blade 433.

Control section 100 performs control to change the rotation speed of brush 432. More specifically, to increase the amount of lubricant supplied to photoconductor drum 413, control section 100 increases the moving speed of brush 432 relative to photoconductor drum 413, and to reduce the amount of lubricant supplied to photoconductor drum 413, control section 100 decreases the moving speed of brush 432 relative to photoconductor drum 413. By changing the rotation speed of brush 432 in this way, it is possible to change the amount of lubricant supplied to photoconductor drum 413.

Note that the rotation speed of brush 432 may be calculated from a table associated with an area ratio of the toner image and a background part potential difference or the like stored in storage section 72 in advance or may be set through experiments or the like as appropriate.

When the number of prints in a printing job reaches a specified number of prints, control section 100 performs control to form a background image in a background image formation region which is different from the toner image formation region of photoconductor drum 413. This allows the lubricant in developing section 412B to be ejected onto photoconductor drum 413.

A series of operations of supply and collection of lubricant by image forming apparatus 1 will be described, which is provided with control section 100 according to Embodiment 2 configured as described above.

First, when photoconductor drum 413 and brush 432 start rotating, lubricant is supplied to photoconductor drum 413. A portion of photoconductor drum 413 to which the lubricant is supplied moves to a portion facing developing sleeve 412A along with the rotation of photoconductor drum 413 as in the case of aforementioned Embodiment 1.

Here, in this portion, since an electric field in a negative direction applies to a direction from photoconductor drum 413 to developing sleeve 412A due to an image part potential difference, the amount of positively charged lubricant collected by developing sleeve 412A increases. When the amount of lubricant collected by developing sleeve 412A increases, the amount of lubricant in developing section 412B increases, which may cause quality problems such as fog toner.

However, since control section 100 performs control to form a background image in Embodiment 2, lubricant G is less likely to be collected from photoconductor drum 413 to developing sleeve 412A as in the case of Embodiment 1. This prevents the amount of lubricant from increasing excessively in developing section 412B, and by extension, can prevent the occurrence of quality problems such as fog toner.

Figure 8:
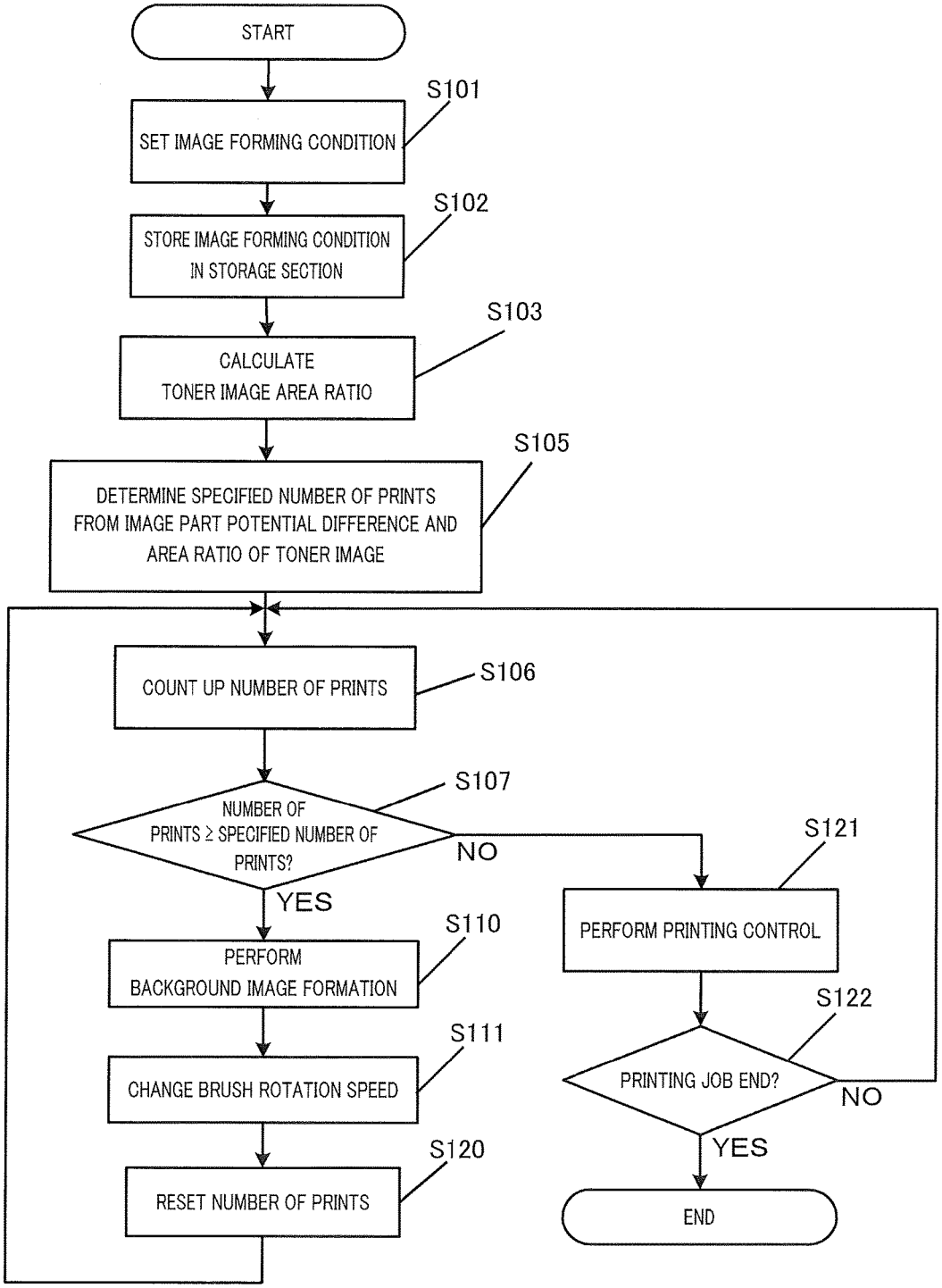
FIG. 8 is a flowchart illustrating an operation example of lubricant amount control in the developing section according to Embodiment 2.

FIG. 8 is a flowchart illustrating an operation example of lubricant amount control in developing section 412B by control section 100 according to Embodiment 2. Processes in FIG. 8 are executed when control section 100 receives an instruction for executing a printing job, and then control section 100 causes photoconductor drum 413 and brush 432 to rotate.

Processes at step S101 to step S103 are similar to the processes in FIG. 6, and control section 100 transitions to a process at step S105 after step S103. Processes at step S105 to step S107 are similar to the processes in FIG. 6, and when "YES" is determined at step S107, a background image is formed (step S110). More specifically, control section 100 performs control to change the background part potential difference in background image formation according to the image area ratio.

Next, control section 100 changes the rotation speed of brush 432 (step S111). To be more specific, to increase the amount of lubricant supplied to photoconductor drum 413, control section 100 increases the rotation speed of brush 432, and to decrease the amount of lubricant supplied to photoconductor drum 413, control section 100 decreases the rotation speed of brush 432. After that, control section 100 transitions to a process at step S120. Processes in and after step S120 and a process at step S107 in which "NO" is determined are similar to those in FIG. 6.

According to the above-described configuration, control section 100 controls the amount of lubricant in developing section 412B based on the image part potential difference and the area ratio of the toner image, and it is thereby possible to control the amount of lubricant in developing section 412B and on photoconductor drum 413 to an appropriate amount.

Furthermore, since control section 100 performs control to form a background image based on the image part potential difference and the area ratio of the toner image, it is possible to prevent the amount of lubricant from increasing excessively in developing section 412B, and by extension, prevent the occurrence of fog toner, image quality degradation or the like. Since the amount of lubricant supplied from developing section 412B to photoconductor drum 413 together with toner never increases excessively, it is possible to prevent the torque between photoconductor drum 413 and drum cleaning blade 415A from increasing and prevent turn-up or abrasion of drum cleaning blade 415A.

Note that in Embodiment 2, control section 100 performs control to form a background image, but without being limited to this, control to form a patch image may be executed. Such a configuration also allows lubricant together with toner to be ejected onto photoconductor drum 413. Considering the fact that lubricant is more easily moved from developing section 412B to photoconductor drum 413 during background image formation, control section 100 preferably performs control to form a background image when ejecting the lubricant.

In the above-described embodiments, control section 100 performs control to form a patch image and a background image at timing after a certain number of sheets are printed and a toner image formation region is formed but before the next toner image formation region is formed, but the present invention is not limited to this. For example, after printing a certain number of sheets, control section 100 may suspend the printing job and perform the control.

Furthermore, when control section 100 can predict a change in the amount of lubricant on photoconductor drum 413 based on the specified number of prints, the area ratio of the toner image and image part potential difference, control section 100 may perform the control before printing operation. In this case, by setting the total of area ratios of an image printed and a patch image to a certain value or greater, it is possible to prevent the amount of lubricant in developing section 412B from reducing during the printing operation.

In the above-described embodiments, a specified number of prints are determined from the image part potential difference and the area ratio of the toner image, but the present invention is not limited to this, and the specified number of prints may be determined from the background part potential difference and the image part potential difference, and the area ratio of the toner image under a set image forming condition.

According to the above-described embodiments, control of the development condition is control to change the image part potential difference and background part potential difference, but the present invention is not limited to this. For example, the control of the development condition may be control to change the distance between photoconductor drum 413 and developing sleeve 412A or control to change the speed ratio of developing sleeve 412A to photoconductor drum 413.

In addition, the above embodiments have merely described a specific example of implementing the present invention, and the technical scope of the present invention should by no means be interpreted restrictively. That is, the present invention can be implemented in various forms without departing from the spirit and scope or principal features of the present invention.

The present invention is applicable to an image forming system composed of a plurality of units including an image forming apparatus. Examples of the plurality of units include a post-processing apparatus, an external apparatus such as a control apparatus connected via a network, and the like.

Lastly, results of respective evaluation experiments according to Embodiment 1 will be described.

[First Evaluation Experiment]

Figure 9:
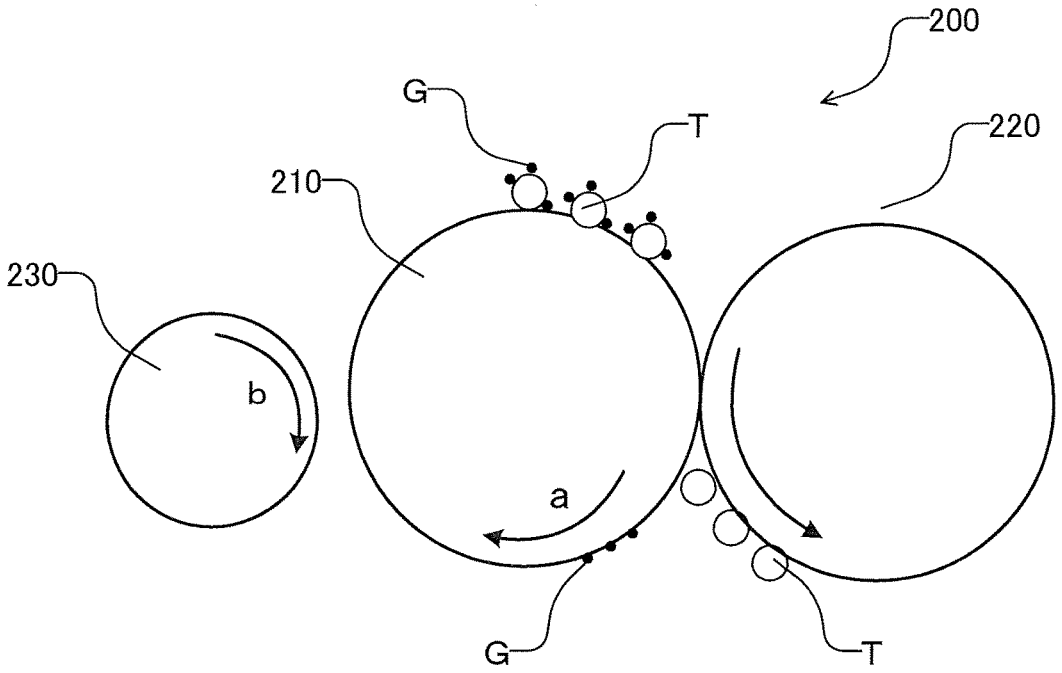
FIG. 9 is a diagram illustrating an evaluation apparatus according to a first evaluation experiment.
Figure 10:
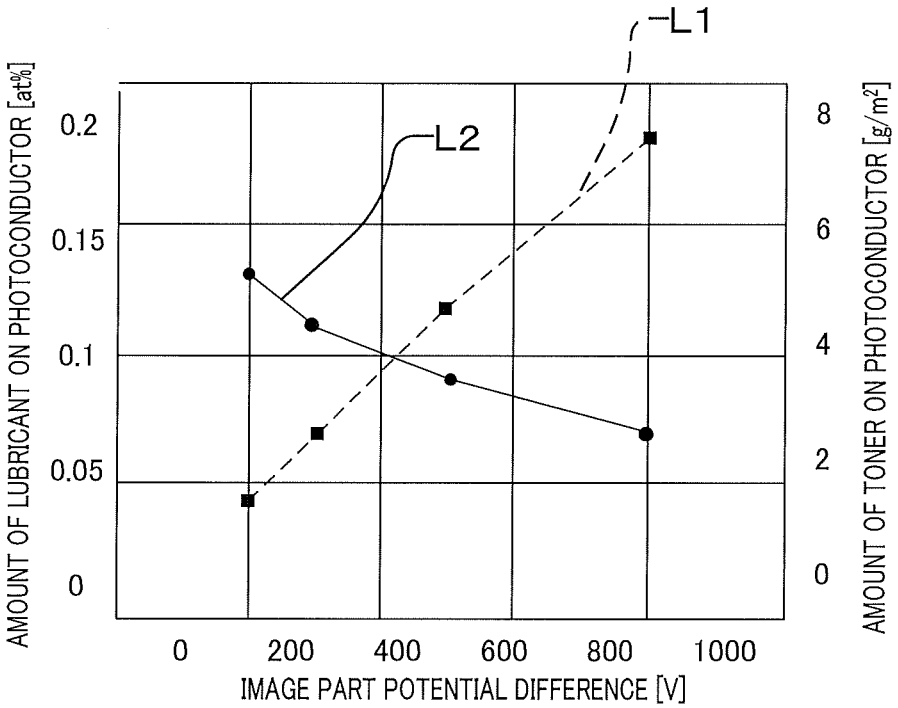
FIG. 10 is a diagram illustrating the results of the experiments of the first evaluation experiment.

A first evaluation experiment verified a change in the amount of lubricant G on photoconductor drum 210 when a potential difference between the surface potential of photoconductor drum 210 and a developing bias was changed. FIG. 9 is a diagram illustrating an evaluation apparatus according to the first evaluation experiment and FIG. 10 is a diagram illustrating the results of the first evaluation experiment.

As shown in FIG. 9, as evaluation apparatus 200 according to the first evaluation experiment, evaluation apparatus 200 composed of photoconductor drum 210, transfer roller 220 and developing sleeve 230 was used. The evaluation conditions were set as follows.

(1) Photoconductor Drum

Photoconductor drum 210 used herein is configured such that a photosensitive layer made of polycarbonate resin and having a thickness of 25 [μm] was formed on a surface of an aluminum cylindrical member having an outer diameter of 100 [mm] and a length of 100 [mm]. Photoconductor drum 210 was rotated at 400 [mm/sec] in an arrow "a" direction.

(2) Transfer Roller

Transfer roller 220 used herein is one provided with a conductive rubber layer on a surface thereof. Transfer roller 220 contacts photoconductor drum 210 and is driven to rotate by rotation of photoconductor drum 210.

(3) Developing Sleeve

Developing sleeve 230 used herein is an aluminum cylindrical member having an outer diameter of 50 [mm]. Developing sleeve 230 is disposed so as to face photoconductor drum 210 at a distance of 300 [μm] and rotates in an arrow "b" direction at 600 [mm/sec].

(4) Toner

Toner T used herein is one to which a zinc stearate is added as lubricant G.

In evaluation apparatus 200 described above, photoconductor drum 210 was connected to GND, the transfer voltage of transfer roller 220 was set to 500 [V], a developing bias on which an alternating current voltage having a frequency of 10000 [Hz] and an amplitude of 900 [V] is superimposed was applied to developing sleeve 230 for a certain period during which photoconductor drum 210 made one revolution. Furthermore, toner of 260 [g/m$^2$] was held on the peripheral surface of developing sleeve 230.

In such evaluation apparatus 200, when photoconductor drum 210 was caused to rotate one turn while developing sleeve 230 was rotated, a toner image was formed on photoconductor drum 210 and the toner image was transferred to transfer roller 220. After the transfer, lubricant G separated from the toner image was attached to photoconductor drum 210. After that, without cleaning photoconductor drum 210, toner T on transfer roller 220 was cleaned, and similar operations were repeated, and it is thereby possible to reproduce the state after the transfer from the development using the actual machine.

Using above-described evaluation apparatus 200, the direct current component of the developing bias was changed, the operation up to the cleaning of toner T after the transfer was repeated five times, and the amount of lubricant G supplied onto photoconductor drum 210 was examined. The developing bias was assumed to have a range of −200 to −800 [V]. That is, the potential difference between photoconductor drum 210 and developing sleeve 230 was assumed to be a range of 200 to 800 [V]. As for the amount of lubricant G, the ratio of zinc with respect to the zinc stearate obtained using an X-ray photoelectron spectroscopy was used as a substitute.

FIG. 10 illustrates the results of the first evaluation experiment. In FIG. 10, broken line L1 shows the amount of toner T on photoconductor drum 210 and solid line L2 shows the amount of lubricant G on photoconductor drum 210. From this, it has been possible to confirm that the smaller the potential difference between photoconductor drum 210 and developing sleeve 230, the greater the amount of lubricant G on photoconductor drum 210 became. It has also been possible to confirm that the smaller the potential difference, the smaller the amount of toner T on photoconductor drum 210 became.

Considering that lubricant G having a diameter smaller than that of toner T is attached to toner T and moved to the photoconductor drum 210 side, it is possible to assume that, if the image part potential difference increases, the amount of lubricant G supplied onto photoconductor drum 210 also increases as the amount of toner T on photoconductor drum 210 increases. However, according to the results in FIG. 10, the amount of toner T on photoconductor drum 210 actually increases by increasing the image part potential difference, whereas the amount of lubricant G on photoconductor drum 210 decreases.

Reasons for this will be described below. As described above, lubricant G remaining on photoconductor drum 210 after the transfer is conveyed to developing sleeve 230 again. At this time, since a force acts on lubricant G on photoconductor drum 210 to move to the developing sleeve 230 side due to the image part potential difference, part of lubricant G is collected by developing sleeve 230. When the image part potential difference is large, the force for lubricant G to move to the developing sleeve 230 side increases, and so the amount of lubricant G that moves to the developing sleeve 230 side increases, and as a result, the amount of lubricant G on photoconductor drum 210 decreases.

Thus, since lubricant G is supplied to photoconductor drum 210 and lubricant G is collected from photoconductor drum 210 at the position of developing sleeve 230, it is possible to assume that the amount of lubricant G on photoconductor drum 210 is determined by the magnitude of the image part potential difference. For this reason, by changing the image part potential difference according to the area ratio of the toner image, it is possible to accurately adjust the amount of lubricant in the developing section.

[Second Evaluation Experiment]

Figure 11A:
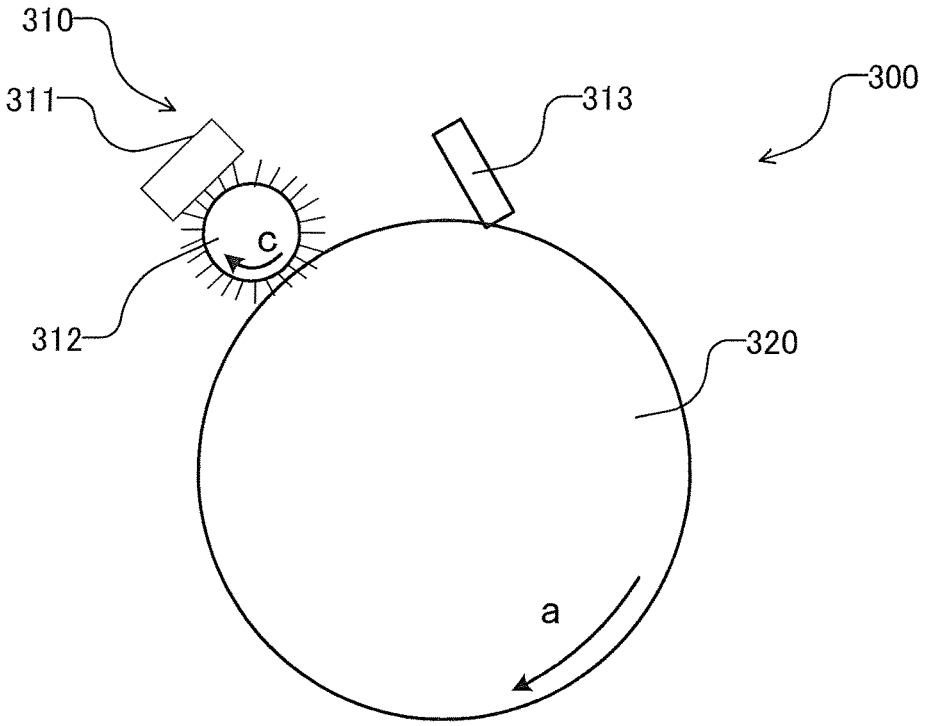
FIG. 11A is a diagram illustrating the first evaluation apparatus in a second evaluation experiment.

In a second evaluation experiment, it has been checked whether or not lubricant G on photoconductor drum 320 could be collected by developing sleeve 330. FIG. 11A is a diagram illustrating first evaluation apparatus 300 according to the second evaluation experiment and FIG. 11B is a diagram illustrating second evaluation apparatus 301 according to the second evaluation experiment.

Figure 11B:
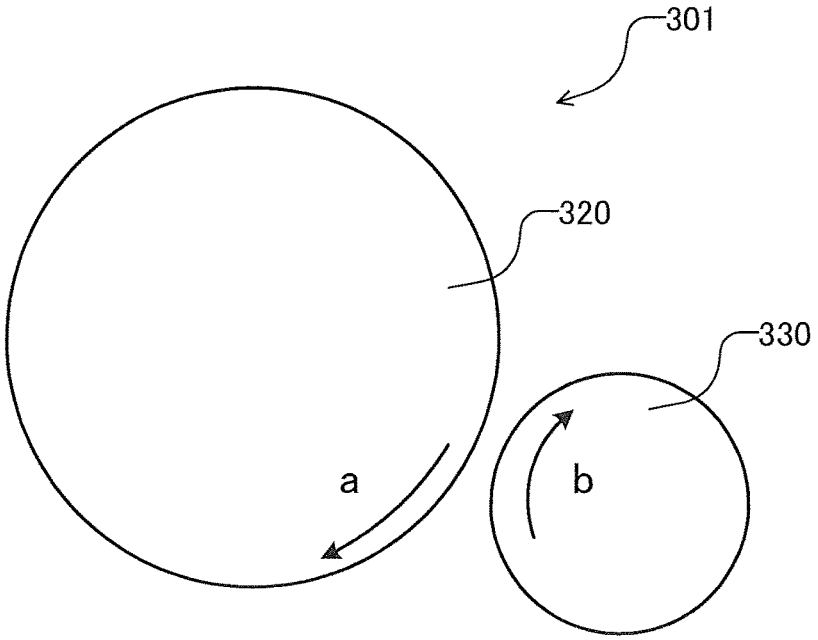
FIG. 11B is a diagram illustrating a second evaluation apparatus in the second evaluation experiment.

The evaluation apparatuses according to the second evaluation experiment used herein are first evaluation apparatus 300 composed of lubricant application section 310 and photoconductor drum 320 shown in FIG. 11A, and second evaluation apparatus 301 composed of photoconductor drum 320 and developing sleeve 330 shown in FIG. 11B. Evaluation conditions were set as follows.

(1) First Evaluation Apparatus

Lubricant application section 310 used herein is one composed of lubricant rod 311 which is a zinc stearate compressed into a rod shape using compression molding, polyester brush 312, polyurethane rubber blade 313. Brush 312 rotates in an arrow "c" direction at 300 [mm/sec]. Photoconductor drum 320 used herein is one having the same conditions as those in the first evaluation experiment.

(2) Second Evaluation Apparatus

Second evaluation apparatus 301 used herein corresponds to first evaluation apparatus 300 after the experiment in which lubricant application section 310 is removed and only developing sleeve 330 is disposed so as to face photoconductor drum 320 at a distance of 300 [μm]. Developing sleeve 330 used herein is one having the same conditions as those in the first evaluation experiment.

With first evaluation apparatus 300 and second evaluation apparatus 301, photoconductor drum 320 was connected to GND and a developing bias having a Vdc of 200 [V], a frequency of 10000 [Hz], and an amplitude of 900 [V] was applied to developing sleeve 330. Toner T of 260 [g/m$^2$] was made to retain on the circumferential surface of developing sleeve 330.

Using such first evaluation apparatus 300, brush 312 and photoconductor drum 320 were caused to make revolutions for a prescribed time, lubricant G was supplied onto photoconductor drum 320 and the lubricant was fixed onto photoconductor drum 320 using rubber blade 313. The amount of lubricant G on photoconductor drum 320 at this time was measured using X-ray photoelectron spectroscopy.

Using second evaluation apparatus 301, photoconductor drum 320 was caused to make 10 revolutions while rotating developing sleeve 330 and the amount of lubricant on photoconductor drum 320 at that time was measured using X-ray photoelectron spectroscopy.

As a result, it has been confirmed that while the amount of lubricant on photoconductor drum 320 in first evaluation apparatus 300 was 0.5 [at %], the amount of lubricant on photoconductor drum 320 in second evaluation apparatus 301 was 0.21 [at %]. That is, it has been confirmed that the lubricant on photoconductor drum 320 was collected by developing sleeve 330.

[Third Evaluation Experiment]

A third evaluation experiment verified statuses of slipping and grain noise when an image with a low area ratio was printed. The evaluation apparatus used herein is image forming apparatus 1 shown in FIG. 1 and FIG. 2. Evaluation conditions were set as follows.

(1) Photoconductor Drum

Photoconductor drum 413 used herein is an organic photoconductor having a diameter of 80 [mm] in which a photosensitive layer made of polycarbonate resin and having a thickness of 25 [μm] was formed on an outer circumferential surface of a metal substrate on an aluminum drum. Photoconductor drum 413 rotates at 400 [mm/sec].

(2) Developing Device

Developing device 412 used herein is provided with developing sleeve 412A which is driven to rotate at a rotation speed of 600 [mm/sec], in which a developing bias having a polarity identical to a surface potential of photoconductor drum 413 was applied to developing sleeve 412A and reversal development was conducted by a two-component developer.

(3) Intermediate Transfer Belt

Intermediate transfer belt 421 used herein is an endless belt made of polyimide resin having conductivity. Primary transfer roller 422 was provided which makes pressure contact with photoconductor drum 413 with intermediate transfer belt 421 therebetween, and to which a primary transfer bias having a polarity opposite to the charging polarity of the toner was applied.

(4) Drum Cleaning Blade

Drum cleaning blade 415A used herein is made of urethane rubber, and has an impact resilience coefficient of 50[%] (25[° C.]), a JISA hardness of 70 degrees, a thickness of 2 [mm], a free length of 10 [mm], and a width of 324 [mm]. Drum cleaning blade 415A was set to have a contact load of 20 [N/m] and a contact angle of 15 degrees with respect to photoconductor drum 413.

(5) Toner

The toner of the two-component developer used herein is produced by an emulsion polymerization method, composed of toner particles having a volume-mean particle diameter of 6.5 [μm] and having negative charging property. Furthermore, 0.2 pts. wt. of zinc stearate added to the toner particles as lubricant G was used.

In above-described image forming apparatus 1, charging potential Vo of photoconductor drum 413 was set to −750 [V] and light exposure potential Vi of photoconductor drum 413 was set to −100 [V]. A developing bias having a frequency of 10000 [Hz], an amplitude of 900 [V] and a direct current component of −500 [V] was applied to developing sleeve 412A so that the image part potential difference became 400 [V].

Figure 12:
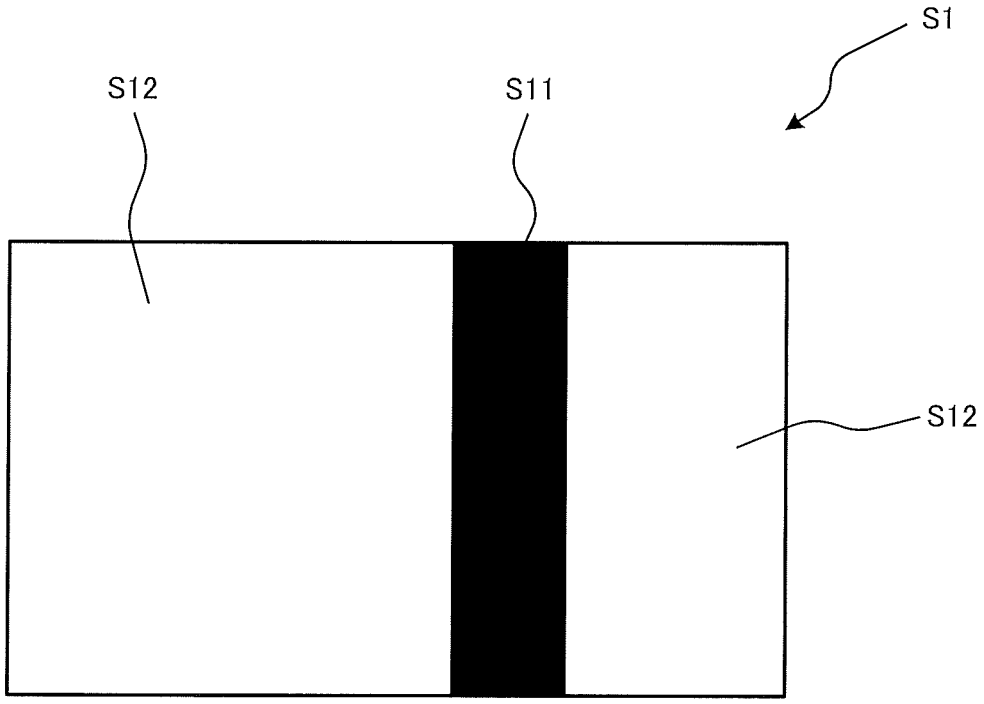
FIG. 12 is a diagram illustrating a longitudinal band chart.

Using above-described image forming apparatus 1, statuses of slipping, grain noise and fog toner were verified in a low temperature low humidity environment with a temperature of 10 [° C.] and a relative humidity of 20[%] by conducting real-action tests of up to a number of prints of 5000. The sheet used herein is longitudinal band chart S1 shown in FIG. 12 prone to grain noise as an image pattern.

Longitudinal band chart S1 is a sheet composed of black-color black portion S11 disposed a little to the right of the center in the direction in which the long side extends and white-color white portions S12 disposed on both sides of black portion S11 in the direction in which the long side extends. Longitudinal band chart S1 is conveyed in the direction in which the short side extends.

Table 1 illustrates statuses of slipping and grain noise when images having toner image area ratios of 1 to 6[%] are printed.

TABLE 1

| AREA RATIO OF TONER IMAGE | | 1% | 2% | 3% | 4% | 5% | 6% |
|---|---|---|---|---|---|---|---|
| NUMBER OF PRINTS (SHEETS) | 1000 | N | N | N | N | N | N |
| | 2000 | Y | N | N | N | N | N |
| | 3000 | Y | Y | Y | N | N | N |
| | 4000 | Y | Y | Y | Y | N | N |
| | 5000 | Y | Y | Y | Y | Y | N |

In Table 1, "N" in the item "number of prints" indicates that neither slipping nor grain noise has occurred, while "Y" in the same item indicates that slipping and grain noise have occurred.

From the results in Table 1, it is possible to confirm that regarding images with low area ratios, statuses of slipping and grain noise vary depending on the area ratio; as the area ratio becomes smaller, slipping and grain noise start to occur at a point in time when the number of prints is still small. On the other hand, when the area ratio is 6%, it is possible to confirm that neither slipping nor grain noise occurs up to a number of prints of 5000.

[Fourth Evaluation Experiment]

A fourth evaluation experiment verified statuses of slipping and grain noise when the image part potential difference was changed from that in the third evaluation experiment. The fourth evaluation experiment also verified statuses of fogging and image quality degradation when forming images with a high area ratio.

As evaluation conditions, the direct current component of developing bias Vdc applied to developing sleeve 412A was set to −300 [V] in Example 1 so that the image part potential difference became 200 [V], −500 [V] in Example 2 so that the image part potential difference became 400 [V] as in the case of experiment 3, and −700 [V] in Example 3 so that the image part potential difference became 600 [V]. The other evaluation conditions were assumed to be conditions similar to those of the third evaluation experiment.

Table 2 illustrates the number of prints when a quality problem occurs when the area ratio of the toner image is changed in each example.

200 [V] compared to Embodiment 2, that is, when the image part potential difference is 400 [V].

On the other hand, it is possible to confirm that quality problems such as slipping or grain noise are less likely to occur in Example 3, that is, when the image part potential difference is 600 [V] compared to Example 2, and no quality problem occurs when the area ratio of the toner image is 5 [%] in particular.

From this, it is possible to confirm that the image part potential difference has an influence on the occurrence of slipping or grain noise in image with a low area ratio. To be more specific, when the image part potential difference is small, the force acting on developing sleeve 412A to collect lubricant G from photoconductor drum 413 is small, and slipping and grain noise are likely to occur. On the other hand, when the image part potential difference is large, the force acting on developing sleeve 412A to collect lubricant G from photoconductor drum 413 is large, and slipping and grain noise are less likely to occur.

On the other hand, images with a high area ratio are influenced by the image part potential difference. More specifically, it has been confirmed that in the case of Example 1, less lubricant is collected into developing section 412B and the amount of lubricant in developing section 412B decreases, less fog toner occurs, and the number of prints increases compared to Example 2. Moreover, it has been confirmed that in the case of Example 3, more lubricant is collected into developing section 412B, the amount of lubricant in developing section 412B increases, more fog toner occurs, and the number of prints decreases compared to Example 2.

When changing the developing bias, it is preferable to change charging potential Vo of photoconductor drum 413 in accordance with the developing bias and perform control so that the background part potential difference becomes constant. One reason is that when the background part potential difference is changed, the amount of lubricant ejected to photoconductor drum 413 at the background part potential difference is changed, which may also influence the amount of lubricant in developing section 412B.

Furthermore, as is clear from the results in Table 1, when images with a low area ratio are printed, neither slipping nor grain noise occurs for up to 5000 sheets when the area ratio of the toner image is 6[%], and therefore if the area ratio of the toner image is equal to or greater than a certain value for

TABLE 2

| | IMAGE PART POTENTIAL DIFFERENCE | AREA RATIO OF TONER IMAGE 1% | 3% | 5% | 70% | 80% |
|---|---|---|---|---|---|---|
| Example 1 | 200 V | 1,000 SHEETS | 1,500 SHEETS | 2,000 SHEETS | 4,000 SHEETS | 2,000 SHEETS |
| Example 2 | 400 V | 2,000 SHEETS | 4,000 SHEETS | 5,000 SHEETS | 2,000 SHEETS | 1,000 SHEETS |
| Example 3 | 600 V | 3,500 SHEETS | 5,000 SHEETS | — | 1,000 SHEETS | 500 SHEETS |
| QUALITY PROBLEM CAUSED | | SLIPPAGE, GRAIN NOISE | | | FOGGING, IMAGE QUALITY DEGRADATION | |

In Table 2, for example, "1000 sheets" in the item "area ratio of toner image" indicates that a quality problem has occurred when 1000 sheets are printed.

It is possible to confirm from the results in Table 2 that in the case of an image with a low area ratio, that is, an image in which the area ratio of a toner image is 1 to 5 [%], the number of prints is smaller and quality problems such as slipping or grain noise are more likely to occur in Embodiment 1, that is, when the image part potential difference is the number of prints, it is assumed that neither slipping nor grain noise occurs. For this reason, if the ratio of toner image is secured as the overall printing operation by forming a patch image in addition to the toner image in the toner image formation region at the start of printing, it is possible to prevent a reduction of the amount of lubricant in developing section 412B. When calculating an area ratio of the toner image in a necessary patch image, it is possible to calculate the area ratio of the toner image by taking into account the image part potential difference and thereby more efficiently control the amount of lubricant in developing section 412B.

Note that since the amount of lubricant supplied to photoconductor drum 413 and the amount of lubricant collected to developing section 412B also vary depending on the image part potential difference, the background part potential difference, the amount of toner, the distance between photoconductor drum 413 and developing sleeve 412A, development conditions such as the speed ratio of developing sleeve 412A with respect to photoconductor drum 413, and the type of lubricant or the like, the aforementioned results of the experiments are not applicable.

Next, results of an evaluation experiment according to Example 2 will be described.

[Fifth Evaluation Experiment]

A fifth evaluation experiment verified a change in the number of prints when fogging occurred by change the image part potential difference according to Embodiment 2. The evaluation apparatus used herein corresponds to image forming apparatus 1 shown in FIG. 1 and FIG. 2 provided with lubricant application section 430 shown in FIG. 7. Evaluation conditions were set as follows.

(1) Lubricant Rod

Lubricant rod 431 used herein is a zinc stearate compressed into a rod shape through compression molding.

(2) Brush

Brush 432 used herein is a polyester one having a rotation speed of 300 [mm/sec].

(3) Blade

Blade 433 used herein is a polyurethane leveling blade.

In above-described image forming apparatus 1, charging potential Vo of photoconductor drum 413 was set to −750 [V] and light exposure potential Vi of photoconductor drum 413 was set to −100 [V]. A developing bias having a frequency of 10000 [Hz] and an amplitude of 900 [V] was applied to developing sleeve 412A. A direct current component of developing bias Vdc was changed from −300 [V], to −500 [V] and −700 [V] so that the image part potential difference became 200 [V], 400 [V] and 600 [V].

Furthermore, in a lubricant application process, when images having a low area ratio are successively printed, it is a known fact that lubricant is easily collected into developing section 412B and fog toner is likely to occur in a background section, and so the area ratio of the toner image was set to 5[%].

Using above-described image forming apparatus 1, the number of prints when fog toner would occur in each image part potential difference was verified by conducting real-action tests of up to a number of prints of 5000 in a low temperature low humidity environment with a temperature of 10° C. and a relative humidity of 20[%]. The sheet used herein is longitudinal band chart S1 shown in FIG. 12 prone to grain noise as an image pattern.

Table 3 illustrates the results of the experiment of the number of prints when fog toner occurs in each image part potential difference.

TABLE 3

| IMAGE PART POTENTIAL DIFFERENCE | NUMBER OF SHEETS WITH FOGGING |
|---|---|
| 200 V | 11000 SHEETS |
| 400 V | 9500 SHEETS |
| 600 V | 8500 SHEETS |

From the results shown in Table 3, it has been possible to confirm that the number of prints when fog toner occurs varies depending on the image part potential difference. More specifically, when the image part potential difference is 200 [V], the force to collect lubricant from photoconductor drum 413 is weaker and the increase in the amount of lubricant in developing section 412B is smaller compared to when the image part potential difference is 400 [V], and as a result, it is possible to confirm that the occurrence of fog toner is delayed.

On the other hand, when the image part potential difference is 600 [V], the force to collect lubricant from photoconductor drum 413 is stronger and the increase in the amount of lubricant in developing section 412B is larger compared to when the image part potential difference is 400 [V], and so, as a result, it is possible to confirm that the occurrence of fog toner occurs earlier.

In lubricant application section 430, the lubricant supplied onto photoconductor drum 413 by brush 432 is fixed onto photoconductor drum 413 by passing through blade 433. However, the lubricant is not fixed sufficiently by passing through the portion of blade 433 only once, and so, the lubricant is collected into developing section 412B by developing sleeve 412A. In the case of a toner image with a high area ratio, the lubricant is generally collected through polishing by drum cleaning blade 415A, but in the case of a toner image with a low area ratio, the amount of lubricant collected by drum cleaning blade 415A is small, and so the collection of lubricant in developing section 412B is more noticeable.

According to the results in Table 3, the amount of lubricant collected into developing section 412B can be controlled efficiently by taking into account the area ratio of the toner image and the image part potential difference. It is possible to prevent quality problems such as fog toner by predicting a change in the amount of lubricant in developing section 412B from the area ratio of the toner image and the image part potential difference, and performing the aforementioned control.

What is claimed is:

1. An image forming apparatus comprising:

an image bearing member to which lubricant is supplied;

a developing section configured to form a toner image by attaching toner to an electrostatic latent image formed on the image bearing member; and a control section configured to control an amount of the lubricant in the developing section based on an area ratio of the toner image formed on the image bearing member and a development condition when the toner image is formed by the developing section, wherein the control section performs the control such that the lubricant is moved to the image bearing member from the developing section using the toner, and the development condition is a potential difference between a developing bias when the toner image is formed and a surface potential in the image bearing member.

2. The image forming apparatus according to claim 1, wherein the developing section supplies the lubricant onto the image bearing member by forming the toner image using the toner to which the lubricant has been added, and the development condition is a first potential difference between a developing bias when the toner image is formed and a first surface potential in a toner image formation region of the image bearing member in which the toner image is formed.

3. The image forming apparatus according to claim 1, wherein the developing section forms the toner image using the toner to which the lubricant has been added and thereby supplies the lubricant onto the image bearing member, and the control section controls the amount of lubricant in the developing section based on a first potential difference between a developing bias when the toner image is formed and a first surface potential of a toner image formation region of the image bearing member in which the toner image is formed and a second potential difference between the developing bias and a second surface potential of a background region of the image bearing member in which the toner image is not formed.

4. The image forming apparatus according to claim 1, wherein the developing section forms, on the image bearing member, a patch image in a patch image formation region which is different from a toner image formation region in which the toner image is formed, the patch image being different from the toner image, and when the area ratio of the toner image is smaller than a first predetermined area ratio, the control section controls the developing section, thereby controlling the amount of lubricant in the developing section via formation of the patch image.

5. The image forming apparatus according to claim 4, wherein the patch image is formed at timing after the toner image formation region is formed but before a toner image formation region subsequent to the toner image formation region is formed.

6. The image forming apparatus according to claim 1, wherein the developing section forms, on the image bearing member, a background image in a background image formation region which is different from a toner image formation region in which the toner image is formed, and when the area ratio of the toner image is greater than a second predetermined area ratio, the control section controls the developing section, thereby controlling the amount of lubricant in the developing section via formation of the background image.

7. The image forming apparatus according to claim 6, wherein the background image is formed at timing after the toner image formation region is formed but before a toner image formation region subsequent to the toner image formation region is formed.

8. The image forming apparatus according to claim 1, further comprising a lubricant application section configured to supply the lubricant onto the image bearing member by applying the lubricant onto the image bearing member, wherein the control section performs control such that the lubricant is supplied to the image bearing member from the developing section, thereby controlling the amount of lubricant in the developing section.

9. The image forming apparatus according to claim 8, wherein the developing section forms, on the image bearing member, a patch image in a patch image formation region which is different from a toner image formation region in which the toner image is formed, the patch image being different from the toner image, and the control section controls the developing section to form the patch image and thereby controls the amount of lubricant in the developing section.

10. The image forming apparatus according to claim 8, wherein the developing section forms, on the image bearing member, a background image in a background image formation region which is different from a toner image formation region in which the toner image is formed, and the control section controls the developing section to form the background image and thereby controls the amount of lubricant in the developing section.

11. An image forming system composed of a plurality of units including an image forming apparatus, the image forming system comprising:

an image bearing member to which lubricant is supplied;

a developing section that forms a toner image by attaching toner to an electrostatic latent image formed on the image bearing member; and a control section that controls an amount of the lubricant in the developing section based on an area ratio of the toner image formed on the image bearing member and a development condition when the toner image is formed by the developing section, wherein the control section performs the control such that the lubricant is moved to the image bearing member from the developing section using the toner, and the development condition is a potential difference between a developing bias when the toner image is formed and a surface potential in the image bearing member.

12. A lubricant amount control method in an image forming apparatus, the image forming apparatus comprising:

an image bearing member; and a developing section that forms a toner image by attaching toner to an electrostatic latent image formed on the image bearing member, the method comprising:

controlling an amount of lubricant in the developing section based on an area ratio of the toner image formed on the image bearing member to which the lubricant is supplied, and a development condition when the toner image is formed by the developing section, wherein the control is performed such that the lubricant is moved to the image bearing member from the developing section using the toner, and the development condition is a potential difference between a developing bias when the toner image is formed and a surface potential in the image bearing member.

13. The lubricant amount control method according to claim 12, wherein the developing section supplies the lubricant onto the image bearing member by forming the toner image using the toner to which the lubricant has been added, and the development condition is a first potential difference between a developing bias when the toner image is formed and a first surface potential in a toner image formation region of the image bearing member in which the toner image is formed.

14. The lubricant amount control method according to claim 12, wherein the developing section forms the toner image using the toner to which the lubricant has been added and thereby supplies the lubricant onto the image bearing member, and the amount of lubricant in the developing section is controlled based on a first potential difference between a developing bias when the toner image is formed and a first surface potential of a toner image formation region of the image bearing member in which the toner image is formed and a second potential difference between the developing bias and a second surface potential of a background region of the image bearing member in which the toner image is not formed.

15. The lubricant amount control method according to claim 12, wherein the developing section forms, on the image bearing member, a patch image in a patch image formation region which is different from a toner image formation region in which the toner image is formed, the patch image being different from the toner image, and when the area ratio of the toner image is smaller than a first predetermined area ratio, the amount of lubricant in the developing section is controlled by controlling the developing section to form the patch image.

16. The lubricant amount control method according to claim 15, wherein the patch image is formed at timing after the toner image formation region is formed but before a toner image formation region subsequent to the toner image formation region is formed.

17. The lubricant amount control method according to claim 12, wherein the developing section forms, on the image bearing member, a background image in a background image formation region which is different from a toner image formation region in which the toner image is formed, and when the area ratio of the toner image is greater than a second predetermined area ratio, the amount of lubricant in the developing section is controlled by controlling the developing section to form the background image.

18. The lubricant amount control method according to claim 12, wherein the image forming apparatus further comprises a lubricant application section configured to supply the lubricant onto the image bearing member by applying the lubricant onto the image bearing member, wherein control is performed such that the lubricant is supplied to the image bearing member from the developing section, thereby controlling the amount of lubricant in the developing section.

19. The lubricant amount control method according to claim 18, wherein the developing section forms, on the image bearing member, a patch image in a patch image formation region which is different from a toner image formation region in which the toner image is formed, the patch image being different from the toner image, and the developing section is controlled to form the patch image to thereby control the amount of lubricant in the developing section.

20. The lubricant amount control method according to claim 18, wherein the developing section forms, on the image bearing member, a background image in a background image formation region which is different from a toner image formation region in which the toner image is formed, and the developing section is controlled to form the background image to thereby control the amount of lubricant in the developing section.

* * * * *